US009459033B2

(12) United States Patent
Tamaki et al.

(10) Patent No.: US 9,459,033 B2
(45) Date of Patent: Oct. 4, 2016

(54) MULTI AIR-CONDITIONING APPARATUS

(75) Inventors: Shogo Tamaki, Tokyo (JP); Fumitake Unezaki, Tokyo (JP); Tomohiko Kasai, Cypress, CA (US)

(73) Assignee: Mitsubishi Electric Corporation, Tokyo (JP)

( * ) Notice: Subject to any disclaimer, the term of this patent is extended or adjusted under 35 U.S.C. 154(b) by 1063 days.

(21) Appl. No.: 13/565,189

(22) Filed: Aug. 2, 2012

(65) Prior Publication Data

US 2014/0033749 A1 Feb. 6, 2014

(51) Int. Cl.

*F25B 5/00* (2006.01)
*F25B 41/04* (2006.01)
*F25B 49/00* (2006.01)

(52) U.S. Cl.

CPC ..... *F25B 49/005* (2013.01); *F25B 2313/006* (2013.01); *F25B 2313/023* (2013.01); *F25B 2313/0233* (2013.01); *F25B 2313/02331* (2013.01)

(58) Field of Classification Search

CPC ..... F25B 2313/023; F25B 2313/0233; F25B 2313/02331; F25B 2313/006; F25B 5/02
USPC ..... 62/203, 200, 222
See application file for complete search history.

(56) References Cited

U.S. PATENT DOCUMENTS 4,294,309 A * 10/1981 Godard ..... F24D 19/1042 126/400
2004/0020224 A1* 2/2004 Bash ..... F25B 5/02 62/228.4
2006/0130496 A1* 6/2006 Chapman ..... F25F 11/0086 62/126
2010/0174412 A1* 7/2010 Kwon ..... F24F 11/0009 700/275

FOREIGN PATENT DOCUMENTS

JP 55121339 A * 9/1980 ..... F24F 11/00
JP A-09-021573 1/1997
JP 2012-017888 A 1/2012
JP A-2012-017886 1/2012
JP 2012-117804 A 6/2012

OTHER PUBLICATIONS

International Search Report and Written Opinion of the International Searching Authority mailed Jan. 15, 2014 for the corresponding international application No. PCT/JP2013/004619 (with English translation).
Office Action issued Dec. 15, 2015 in the corresponding JP application No. 2015-504655 (with English translation).
Office Action mailed Aug. 2, 2016 issued in corresponding Chinese patent application No. 201380040907.4 (and English translation).

* cited by examiner

*Primary Examiner* — M. Alexandra Elve
*Assistant Examiner* — Daniel C Comings
(74) *Attorney, Agent, or Firm* — Posz Law Group, PLC

(57) ABSTRACT

A correspondence determination operation is performed. The correspondence determination operation differs a direction of distribution or a flow rate of a refrigerant flowing in one or some of use units among a plurality of use units to that of the other use units and determines, on the basis of a refrigerant temperature of the use unit, a location of a non-correspondence between a branch port that is connected to the use unit with refrigerant pipes and a set branch port that is obtained in accordance with the wire connection.

17 Claims, 12 Drawing Sheets

(a) BEFORE SWITCHING (b) AFTER SWITCHING

FIG. 7

| BASE | USE UNIT 303a (5HP) | USE UNIT 303b (1HP) | USE UNIT 303c (3HP) | USE UNIT 303d (1HP) | TOTAL NUMBER OF SWITCHING |
|---|---|---|---|---|---|
| ODD NUMBERED PORT | FIRST TIME | -- | SECOND TIME | -- | 2 TIMES |
| EVEN NUMBERED PORT | -- | FIRST TIME | -- | FIRST TIME | 1 TIME |

MULTI AIR-CONDITIONING APPARATUS

TECHNICAL FIELD

The present invention relates to a multi air-conditioning apparatus of a vapor compression type in which a heat source unit and a plurality of use units are connected through a branch unit, and, more particularly, to a multi air-conditioning apparatus capable of automatic detection of a location where a refrigerant pipe and a transmission line of the use unit and the branch unit is not corresponding.

BACKGROUND ART

Typically, in a multi air-conditioning apparatus formed by connecting at least one heat source unit and a plurality of use units to each other by piping, construction workers carry out connection of refrigerant pipes and wire connection of transmission signal lines (transmission lines) on-site during installation work. The connection of refrigerant pipes and the wire connection of transmission lines are carried out individually; hence, there are cases in which a construction defect such as non-correspondence between a refrigerant pipe and a transmission line occur. Normally, a trial run is carried out after installation work; however, since all of the use units are operated during the trial run, even if there were a non-correspondence between a refrigerant pipe and a transmission line, the operation state will be the same as that when there is no non-correspondence. Accordingly, the non-correspondence between the refrigerant pipes and the transmission lines cannot be detected with the trial run, and there are cases in which a non-correspondence is found after the turn over to the user.

There has been proposed a technique automatically detecting such non-correspondence between the refrigerant pipes and the transmission lines.

For example, an air-conditioning apparatus described in Patent Literature 1 is a system in which each of a plurality of indoor units are connected to corresponding one of branch ports of branch units that have a plurality of electronic expansion valves. Patent Literature 1 discloses a method of detecting the correspondence between each pipe and each wiring of each indoor unit and the corresponding branching unit by making a plurality of indoor units all perform heating operation while each of the electronic expansion valves are dosed one by one.

Further, in an air-conditioning apparatus described in Patent Literature 2, diversion units each control diversion of a refrigerant to a plurality of indoor units. Patent Literature 2 discloses an air-conditioning apparatus that is capable of accurately recognizing the correspondence between each of the indoor units and the corresponding one of solenoid valves of the diversion units in a short time and that is capable of surely performing a desired cooling/heating operation of the indoor units by repeating an operation in which substantially half of the solenoid valves that is in an opened state is dosed and substantially half of the solenoid valves that is in a dosed state is opened for a number of times during trial run.

CITATION LIST

Patent Literature

Patent Literature 1: Japanese Unexamined Patent Application Publication No. 2012-17886 (FIG. 10)

Patent Literature 2: Japanese Unexamined Patent Application Publication No. 9-21573 (FIG. 3)

SUMMARY OF INVENTION

Problem to be Solved by the Invention

However, in the air-conditioning apparatus described in Patent Literature 1, since the determination operation of the plurality of indoor units are performed unit by unit, when there is a large number of connected indoor units, it disadvantageously takes a long time to finish the determination of all of the indoor units.

Further, in the air-conditioning apparatus described in Patent Literature 2, since switching of the solenoid valves are performed without considering the capacity and the operating state of the connected indoor units, there has been disadvantageous cases in which the air-conditioning apparatus turned into an abnormal operation state after the switching rendering the continuance of the determination difficult.

The invention has been made to overcome the above disadvantages and an object thereof is to obtain a multi air-conditioning apparatus, including a heat source unit and a plurality of use units, that is capable of performing detection in a short time while averting the portion of the branch port where there is non-correspondence between the refrigerant pipe and the transmission line to turn into an abnormal state.

Means for Solving Problem

An multi air-conditioning apparatus according to the invention includes at least one heat source unit including a compressor and a heat source side heat exchanger; a plurality of use units each including a use side heat exchanger, use unit refrigerant temperature detection means that detects a use unit refrigerant temperature that is a temperature of a refrigerant that is to flow into the use side heat exchanger or a temperature of the refrigerant that has flowed out from the use side heat exchanger, use unit air temperature detection means that detects a use unit air temperature that is a temperature of air that exchanges heat with the use side heat exchanger; a pipe branch unit connecting one of the at least one heat source unit to the plurality of use units by refrigerant pipes; refrigerant saturation temperature detection means detecting a refrigerant saturation temperature of the at least one heat source unit or the plurality of use units; a unit controller connected to the at least one heat source unit and the plurality of use units by wire connection; the pipe branch unit including a plurality of branch ports that branches the refrigerant pipes connected to the at least one heat source unit, the plurality of branch ports being connected to the plurality of use units by the refrigerant pipes, and a flow control valve provided to each branch port, the flow control valve controlling a direction of distribution or a flow rate of the refrigerant flowing in each of the plurality of use units; and the unit controller including a storage unit that stores capacity information of each of the plurality of use units and that stores information of a set branch port that is obtained in accordance with the wire connection and that indicates a correspondence of each branch port connected to the corresponding one of the plurality of use units, a control unit that performs a correspondence determination operation, the correspondence determination operation operating one or some of the flow control valves among the flow control valves in plural numbers and differentiating the direction of distribution or the flow rate of the refrigerant flowing in one or some of the plurality of use units among the plurality of use units to that of the remaining one or some of the plurality of use units, and a determination unit that determines, based on the use unit refrigerant temperature during performance of the correspondence determination operation, a location of a non-correspondence between each of the plurality of branch ports that is connected to the corresponding one of the plurality of use units by refrigerant pipes and the set branch port obtained in accordance with the wiring connection.

Effect of the Invention

The invention is capable of performing detection in a short time while averting the portion of the branch port where there is non-correspondence between the refrigerant pipe and the transmission line to turn into an abnormal state.

BRIEF DESCRIPTION OF DRAWINGS

FIG. 7 is a schematic diagram illustrating a determination method of a base switching port that performs solenoid valve switching of the multi air-conditioning apparatus 100 of Embodiment 1.

MODES FOR CARRYING OUT THE INVENTION

Embodiment 1

Configuration of Components

The configuration of an air-conditioning apparatus of Embodiment 1 of the invention will be described with reference to the accompanying drawings. Note that in [ ], the unit of the symbols used in the equation in this description will be stated. Further, when dimensionless (no unit), notation [-] will be made.

Figure 1:
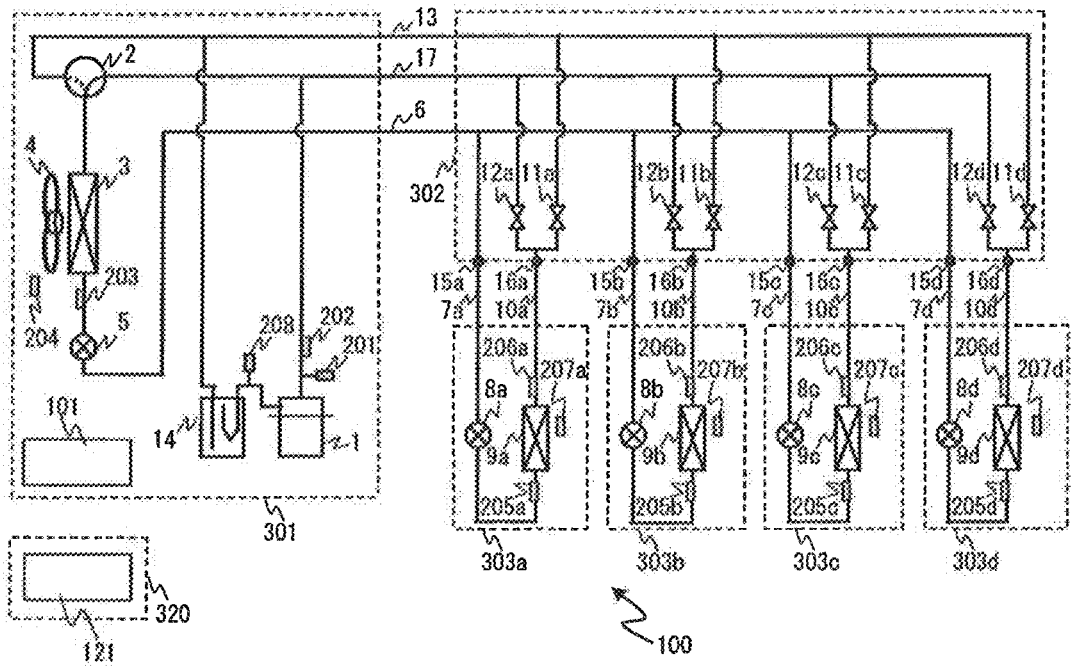
FIG. 1 is a refrigerant circuit diagram of a multi air-conditioning apparatus 100 of Embodiment 1.

FIG. 1 is a refrigerant circuit diagram of a multi air-conditioning apparatus 100 of Embodiment 1.

This multi air-conditioning apparatus 100 is disposed in large-scale commercial facilities and office buildings, for example. By performing a vapor compression refrigeration cycle, the multi air-conditioning apparatus 100 is capable of individually processing a cooling command (cooling ON/OFF) or a heating command (heating ON/OFF) that is selected in each of use units 303*a* to 303*d* and is capable of individually performing heating operation or cooling operation (simultaneous cooling and heating operation) in the use units 303*a* to 303*d*.

In the multi air-conditioning apparatus 100, a heat source unit 301 and a branch unit 302 are connected by liquid pipe 6, low-pressure gas pipe 13, and high-pressure gas pipe 17 that are refrigerant pipes.

The branch unit 302 and the use unit 303*a* are connected with a liquid pipe 7*a* and a gas pipe 10*a* that are refrigerant pipes at branch port 15*a* and branch port 16*a*, respectively.

The branch unit 302 and the use unit 303*b* are connected with a liquid pipe 7*b* and a gas pipe 10*b* that are refrigerant pipes at branch port 15*b* and branch port 16*b*, respectively.

The branch unit 302 and the use unit 303*c* are connected with a liquid pipe 7*c* and a gas pipe 10*c* that are refrigerant pipes at branch port 15*c* and branch port 16*c*, respectively.

The branch unit 302 and the use unit 303*d* are connected with a liquid pipe 7*d* and a gas pipe 10*d* that are refrigerant pipes at branch port 15*d* and branch port 16*d*, respectively.

The refrigerant used in the multi air-conditioning apparatus is not limited to a specific refrigerant. For example, R410A, R32, HFO-1234yf, and a natural refrigerant such as hydrocarbon may be used.

Further, the multi air-conditioning apparatus 100 includes an external controller 320.

<Heat Source Unit 301>

The heat source unit 301 includes a compressor 1, a three-way valve 2, heat source side heat exchanger 3, heat source side fan 4, heat source side decompression mechanism 5, and an accumulator 14.

The compressor 1 sucks in and compresses a refrigerant into a high-temperature high-pressure state. The compressor may be one in which its rotation speed is controlled by an inverter or may be a type with constant speed, for example.

The three-way valve 2 is configured by sealing one of the four ports of a four-way switching valve. That is, the three-way valve 2 has first to third ports in which the first port is connected to the discharge side of the compressor 1, the second port is connected to the heat source side heat exchanger 3, and the third port is connected to the suction side of the compressor 1. The three-way valve 2 is configured such that its setting can be switched between a state in which the first port and the second port are in communication with each other while the third port is dosed (a state indicated by a solid line in FIG. 1) and a state in which the second port and the third port are in communication with each other while the first port is dosed (a state indicated by a broken line in FIG. 1).

The heat source side heat exchanger 3 is, for example, a cross-fin type fin-and-tube heat exchanger including a heat transfer pipe and a plurality of fins. The heat source side heat exchanger 3 exchanges heat between outdoor air and the refrigerant, and exhausts heat.

The heat source side fan 4 includes a fan that is capable of varying a flow rate of the air supplied to the heat source side heat exchanger 3 and is, for example, a propeller fan that is driven by a motor (not shown) constituted by a DC fan motor The heat source side decompression mechanism 5 controls a flow rate of the refrigerant and can be set to vary its opening degree.

The accumulator 14 has a function of retaining a refrigerant that is excessive for a certain operation and a function of detaining liquid refrigerant that is temporarily generated when the operation state is changed so as to prevent a large amount of liquid refrigerant to flow into the compressor 1.

Further, in the heat source unit 301, a pressure sensor 201 is provided on the discharge side of the compressor 1 and a pressure sensor 208 is provided on the suction side of the compressor 1, each measuring the refrigerant pressure at their disposed positions.

Further, in the heat source unit 301, a temperature sensor 202 is provided on the discharge side of the compressor 1 and a temperature sensor 203 is provided on the liquid side of the heat source side heat exchanger 3, each measuring the refrigerant temperature at their disposed positions.

Furthermore, in the heat source unit 301, a temperature sensor 204 is provided in the air suction port and measures the air temperature in its disposed position.

<Branch Unit 302>

The branch unit 302 includes solenoid valves 11*a* to 11*d* and solenoid valves 12*a* to 12*d*. The disposed number of the solenoid valves 11*a* to 11*d* and the number of the solenoid valves 12*a* to 12*d* corresponds to the number of the branch ports 16*a* to 16*d* of the branch unit 302.

The solenoid valves 11*a* to 11*d* are each provided in the corresponding one of the pipes that connects the low-pressure gas pipe 13 and the branch ports 16*a* to 16*d*.

The solenoid valves 12*a* to 12*d* are each provided in the corresponding one of the pipes that connects the high-pressure gas pipe 17 and the branch ports 16*a* to 16*d*.

The solenoid valves 11*a* to 11*d* and the solenoid valves 12*a* to 12*d* control the flow direction of the refrigerant in the use units 303*a* to 303*d* individually. By opening the solenoid valves 12*a* to 12*d* and closing the solenoid valves 11*a* to 11*d*, refrigerant supplying condensation heat can be distributed to the use units 303*a* to 303*d*. By closing the solenoid valves 12*a* to 12*d* and opening the solenoid valves 11*a* to 11*d*, refrigerant supplying evaporation heat can be distributed to the use units 303*a* to 303*d*.

The solenoid valves 11*a* to 11*d* and solenoid valves 12*a* to 12*d* each has a function of a flow control valve.

Further, the branch unit 302 functions as a pipe branch unit that connects the heat source unit 301 and the use units 303*a* to 303*d* with refrigerant pipes.

<Use Units 303*a* to 303*d*>

Use units 303*a* to 303*d* each includes use side decompression mechanisms 8*a* to 8*d* and use side heat exchangers 9*a* to 9*d*, respectively.

Each of the use side decompression mechanisms 8*a* to 8*d* controls the flow rate of the refrigerant and can be set to vary its opening degree. Each of the use side heat exchangers 9*a* to 9*d* is, for example, a cross-fin type fin-and-tube heat exchanger including a heat transfer pipe and a plurality of fins and exchanges heat between the indoor air and the refrigerant.

Further, in the use units 303*a* to 303*d*, temperature sensors 205*a* to 205*d* are provided on the liquid side of the use side heat exchangers 9*a* to 9*d*, respectively, and temperature sensors 206*a* to 206*d* are provided on the gas side of the use side heat exchangers 9*a* to 9*d*, respectively, each measuring the refrigerant temperature at their disposed positions.

Furthermore, in the air suction port of the use units 303*a* to 303*d*, temperature sensors 207*a* to 207*d* are provided, respectively, and measure the air temperature in each of their disposed positions.

<Unit Controller 101, Controller Control Device 121>

The heat source unit 301 is provided with a unit controller 101 that is constituted by, for example, a microcomputer.

The external controller 320 is provided with a controller control device 121 that is equipped with, for example, software.

Figure 2:
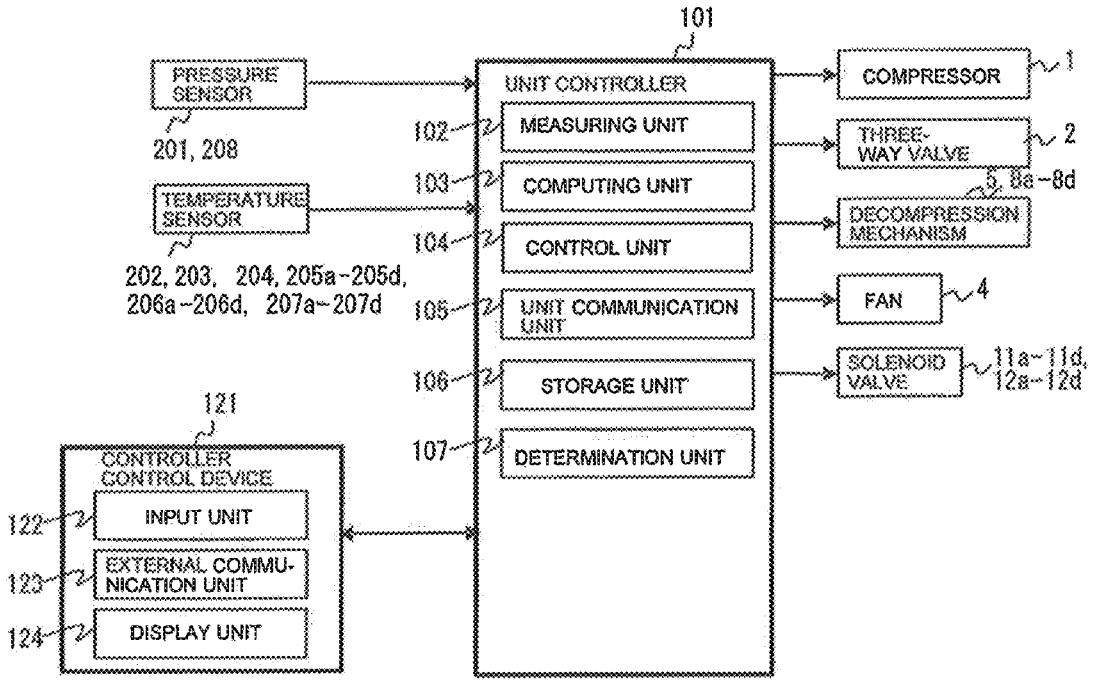
FIG. 2 is a block diagram illustrating a configuration of a unit controller 101 and a controller control device 121 of the multi air-conditioning apparatus 100 of Embodiment 1.

FIG. 2 is a block diagram illustrating a configuration of a unit controller 101 and a controller control device 121 of the multi air-conditioning apparatus 100 of Embodiment 1.

The unit controller 101 includes a measuring unit 102, a computing unit 103, a control unit 104, a unit communication unit 105, a storage unit 106, and a determination unit 107.

The measuring unit 102 is input with amounts detected by each temperature sensor and each pressure sensor.

The computing unit 103 performs calculation for determining various control operations on the basis of information input to the measuring unit 102.

Control unit 104 controls the compressor 1, the three-way valve 2, the heat source side fan 4, the heat source side decompression mechanism 5, the use side decompression mechanisms 8*a* to 8*d*, the solenoid valves 11*a* to 11*d*, and solenoid valves 12*a* to 12*d* on the basis of the calculation result of the computing unit 103.

The unit communication unit 105 is capable of inputting communication data information from communication means such as a telephone line, a LAN line, and wireless and is capable of outputting information externally. The unit communication unit 105 communicates with a use side remote control (not shown) and inputs to the unit controller 101*a* cooling command (cooling ON/OFF) or a heating command (heating ON/OFF) that has been output from the user side remote control. Further, the unit communication unit 105 communicates with the controller control device 121.

The storage unit 106 is constituted by a semiconductor memory or the like and stores quantity of state of operation, such as temperature and pressure; set value; unit information, and the like.

The determination unit 107 determines the correspondence between the refrigerant pipes and the transmission lines.

The controller control device 121 includes an input unit 122, an external communication unit 123, and a display unit 124.

The input unit 122 inputs a command from the user.

The external communication unit 123 communicates with the unit controller 101 on the input result and the unit state.

The display unit 124 displays information that has been communicated with the unit controller 101 and the communication result is displayed on the display of the external controller 320 and the like.

<Operation Modes>

The multi air-conditioning apparatus 100 controls each component that is mounted in the heat source unit 301, the branch unit 302, and the use units 303*a* to 303*d* on the basis of the air conditioning load required in the use units 303*a* to 303*d* and is capable of performing, for example, a cooling only operation mode A and a heating only operation mode B.

First, description will be given on the cooling only operation mode A.

In the cooling only operation mode A, the three-way valve 2 connects the discharge side of the compressor 1 to the gas side of the heat source side heat exchanger 3. Further, the solenoid valves 11*a* to 11*d* are opened, the solenoid valves 12*a* to 12*d* are closed, and the opening degree of the heat source side decompression mechanism 5 is at its maximum (fully opened).

A high-temperature high-pressure gas refrigerant discharged from the compressor 1 flows into the heat source side heat exchanger 3 through the three-way valve 2 and turns into a high-pressure liquid refrigerant by rejecting heat to the outdoor air that has been sent from the heat source side fan 4. Then, the high-pressure liquid refrigerant flows out of the heat source side heat exchanger 3 and flows into the heat source side decompression mechanism 5. The high-pressure liquid refrigerant then flows out of the heat source unit 301 into the branch unit 302 through the liquid pipe 6 and flows out of the branch unit 302 though the branch ports 15*a* to 15*d*.

The high-pressure liquid refrigerant then flows into the use units 303*a* to 303*d* through the liquid pipes 7*a* to 7*d*, respectively, and turns into a low-pressure two-phase refrigerant while undergoing pressure reduction in the use side decompression mechanisms 8*a* to 8*d*. Then, the low-pressure two-phase refrigerant turns into a low-pressure gas refrigerant by cooling the indoor air in the use side heat exchangers 9*a* to 9*d*, flows out of the use units 303*a* to 303*d*, and flows into the branch unit 302 through the gas pipes 10*a* to 10*d* from the branch ports 16*a* to 16*d*.

The low-pressure gas refrigerant then flows into the heat source unit 301 through the solenoid valves 11*a* to 11*d* and the low-pressure gas pipe 13 and is sucked into the compressor 1 again after flowing through the accumulator 14.

Note that the opening degree of each of the use side decompression mechanisms 8*a* to 8*d* is controlled so that the degree of superheat in the corresponding one of the use side heat exchangers 9*a* to 9*d* becomes a predetermined value. The degree of superheat in each of the use side heat exchangers 9*a* to 9*d* is a value obtained by subtracting a detection temperature of the corresponding one of the temperature sensors 205*a* to 205*d* from a detection temperature of the corresponding one of the temperature sensors 206*a* to 206*d*.

Further, the operating frequency of the compressor 1 is controlled so that the evaporating temperature becomes a predetermined value. The evaporating temperature is a saturated gas temperature of the detection pressure of the pressure sensor 208.

Further, the heat source side fan 4 is controlled so that the condensing temperature becomes a predetermined value. The condensing temperature is a saturated gas temperature of the detection pressure of the pressure sensor 201.

Next, description will be given on the heating only operation mode B.

In the heating only operation mode B, the three-way valve 2 connects the gas side of the heat source side heat exchanger 3 to the suction side of the compressor 1. Further, the solenoid valves 11*a* to 11*d* are closed, the solenoid valves 12*a* to 12*d* are opened, and the opening degree of the heat source side decompression mechanism is at its maximum (fully opened).

A high-temperature high-pressure gas refrigerant discharged from the compressor 1 flows out of the heat source unit 301 and flows into the branch unit 302 through the high-pressure gas pipe 17. Then, the high-temperature high-pressure gas refrigerant flows out of the branch unit 302 through the solenoid valves 12*a* to 12*d* from the branch ports 16*a* to 16*d*.

The high-temperature high-pressure gas refrigerant then flows into the use units 303*a* to 303*d* through the gas pipes 10*a* to 10*d*, respectively, and flows into the use side heat exchangers 9*a* to 9*d*, respectively, and turns into a high-pressure liquid refrigerant while heating the indoor air. The high-pressure liquid refrigerant then flows out of the use side heat exchangers 9*a* to 9*d*, turns into a low-pressure two-phase refrigerant while undergoing pressure reduction in the use side decompression mechanisms 8*a* to 8*d*, respectively, and flows out of the use units 303*a* and 303*d*.

Then, the low-pressure two-phase refrigerant flows into the branch unit 302 through the liquid pipes 7*a* to 7*d* from the branch ports 15*a* to 15*d*, respectively, flows out of the branch unit 302, and flows into the heat source unit 301 through the liquid pipe 6.

The low-pressure two-phase refrigerant then passes through the heat source side decompression mechanism 5, flows into the heat source side heat exchanger 3, and turns into a low-pressure gas refrigerant while removing heat from the outdoor air blown from the heat source side fan 4. The low-pressure gas refrigerant flows out of the heat source side heat exchanger 3, passes through the accumulator 14 via the three-way valve 2 and is sucked into the compressor 1 again.

Note that the opening degree of each of the use side decompression mechanisms 8*a* to 8*d* is controlled so that the degree of subcooling in the corresponding one of the use side heat exchangers 9*a* to 9*d* becomes a predetermined value. The degree of subcooling in each of the use side heat exchangers 9*a* to 9*d* is a value obtained by subtracting a temperature detected by the corresponding one of the temperature sensors 205*a* to 205*d* from a saturated liquid temperature detected by the pressure sensor 201.

Further, the operating frequency of the compressor 1 is controlled so that the condensing temperature becomes a predetermined value. The condensing temperature is a saturated gas temperature of the detection pressure of the pressure sensor 201.

Further, the heat source side fan 4 is controlled so that the evaporating temperature becomes a predetermined value.

The evaporating temperature is a saturated gas temperature of the detection pressure of the pressure sensor 208.

Note that in the cooling only operation mode A, the solenoid valves 11*a* to 11*d* are opened and the solenoid valves 12*a* to 12*d* are dosed and in the heating only operation mode B, the solenoid valves 11*a* to 11*d* are closed and the solenoid valves 12*a* to 12*d* are opened. That is, in the multi air-conditioning apparatus 100 according to Embodiment 1, it is possible to individually set the use units 303*a* to 303*d* to have a cooling flow or a heating flow by switching the solenoid valves 11*a* to 11*d* and the solenoid valves 12*a* to 12*d*. For example, when the use unit 303*a* is to have a cooling flow, the solenoid valve 11*a* is opened and the solenoid valve 12*a* is dosed and when the use unit 303*a* is to have a heating flow, the solenoid valve 11*a* is dosed and the solenoid valve 12*a* is opened.

<Connection of Transmission Line During Installation Work>

In order to communicate the operating state and the operation mode of the use units 303*a* to 303*d* and to communicate the operation command of the components, transmission signal lines (transmission lines) are connected between the use units 303*a* to 303*d* and the branch unit 302, and the branch unit 302 and the heat source unit 301.

Figure 3:
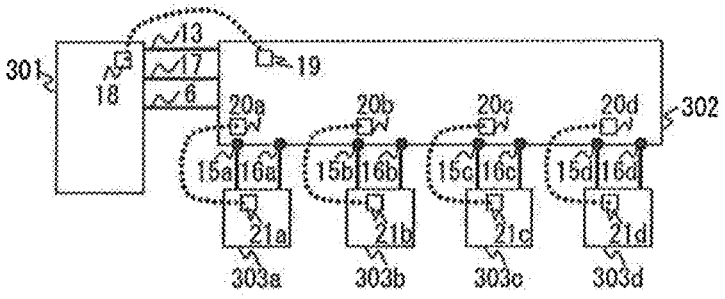
FIG. 3 is a wiring diagram of transmission lines of the multi air-conditioning apparatus 100 of Embodiment 1.

FIG. 3 is a wiring diagram of the transmission lines of the multi air-conditioning apparatus 100 of Embodiment 1.

In the wire connection shown in FIG. 3, a wiring terminal block 18 of the heat source unit 301 and a wiring terminal block 19 of the branch unit 302 are connected with a transmission line. Further, wiring terminal blocks 20*a* to 20*d* of the branch unit 302 and wiring terminal blocks 21*a* to 21*d* of each use units 303*a* to 303*d* are connected to each other, respectively. In the branch unit 302, the wiring terminal block 19 is connected to each of the wiring terminal blocks 20*a* to 20*d*. With such connection of the transmission line, the unit controller 101 is connected to the heat source unit 301, the branch unit 302, and each of the use units 303*a* to 303*d*.

The unit controller 101 obtains, as set branch ports, information on which branch ports 15*a* to 15*d* and branch ports 16*a* to 16*d* are the use units 303*a* to 303*d* connected to by refrigerant piping from the connection state of the transmission lines.

For example, when the wiring terminal block 20*a* of the branch unit 302 and the wiring terminal block 21*a* of the use unit 303*a* are connected by a transmission line, then the branch ports 15*a* and 16*a* are designated as set branch port 1.

Further, when the wiring terminal block 20*b* of the branch unit 302 and the wiring terminal block 21*b* of the use unit 303*b* are connected by a transmission line, then the branch ports 15*b* and 16*b* are designated as set branch port 2.

Furthermore, when the wiring terminal block 20*c* of the branch unit 302 and the wiring terminal block 21*c* of the use unit 303*c* are connected by a transmission line, then the branch ports 15*c* and 16*c* are designated as set branch port 3.

Additionally, when the wiring terminal block 20*d* of the branch unit 302 and the wiring terminal block 21*d* of the use unit 303*d* are connected by a transmission line, then the branch ports 15*d* and 16*d* are designated as set branch port 4.

In addition, the unit controller 101 determines which solenoid valves 11*a* to 11*d* and solenoid valves 12*a* to 12*d* are to be operated on the basis of the obtained set branch ports. Specifically, for example, when the command to the use unit 303*c* is changed from stop to a cooling operation, then, in the branch unit 302, the solenoid valve 11*c* is opened and the solenoid valve 12*c* is dosed on the basis of information on the set branch port of the use unit 303*c*.

When installation work is carried out on-site, the connection of the refrigerant pipes and connection of the transmission lines between each unit are carried out separately by construction workers. Accordingly, as shown in FIG. 4, a wire connection defect may occur such that while the wiring terminal block 20*b* of the branch unit 302 and the wiring terminal block 21*b* of the use unit 303*b* should be connected, the wiring terminal block 20*b* and the wiring terminal block 21*c* of the use unit 303*c* are connected and, further, the wiring terminal block 20*c* and the wiring terminal block 21*b* of the use unit 303*b* are connected, for example.

Since the unit controller 101 recognizes the set branch ports on the basis of the connection state of the transmission lines, when the above wire connection defect is carried out such that there are non-correspondences between the refrigerant pipes and the transmission lines, the proper solenoid valve of the branch port will not be opened/closed.

Figure 4:
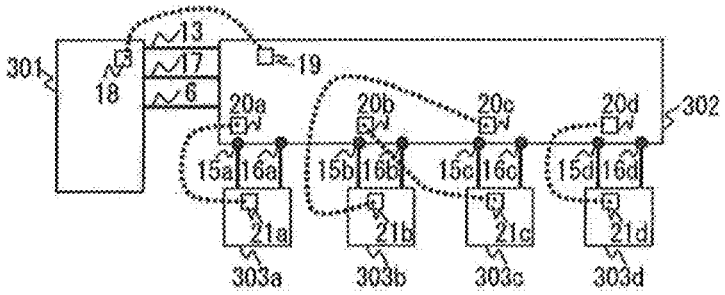
FIG. 4 is a wiring diagram of the transmission lines in a case in which there is a non-correspondence between the transmission line and the connection of the refrigerant pipes of the multi air-conditioning apparatus 100 of Embodiment 1.

For example, in the wire connection of FIG. 4, when the command of the use unit 303*c* is changed from stop to a cooling operation, in the branch unit 302, the solenoid valve 11*b* is opened and the solenoid valve 12*b* is dosed, whereas the solenoid valve 11*c* and the solenoid valve 12*c* is kept closed. Accordingly, no refrigerant will flow into the use unit 303*c*, and the cooling operation as commanded cannot be performed.

Generally, a trial run is performed after construction; however, hitherto, all of the use units 303*a* to 303*d* are operated in the trial run. With such conventional trial runs, the run will be one with the refrigerant flowing in all of the branch ports 15*a* to 15*d* and the branch ports 16*a* to 16*d* of the branch unit 302; hence, even if there is a wrong wiring such as the one shown in FIG. 4, the run will be carried out without any problems and the wrong wiring will not be detected.

Therefore, checking of wrong wiring has been carried out hitherto by operating the use units 303*a* to 303*d* one by one. However, in a case of a multi air-conditioning apparatus 100 disposed in a large-scale commercial facility, the number of use units 303 will be large and it will take considerable time and labor to conduct the check.

Now, with the below operation, it will be possible to check if there is any wrong wiring in a short time.

A frequent case of wrong wiring is one showed in FIG. 4, for example, where there is a wrong connection between neighboring branch ports. If such a case of wrong wiring is made detectable, it will enable detection of wrong wirings in a large number of pieces of real estate.

As a detection method, specifically, there is one described below.

That is, in a trial cooling only operation in which all of the use units 303*a* to 303*d* perform cooling operation, solenoid valves in every other one of the branch ports are switched to a heating flow and the refrigerant temperature of the use units 303*a* to 303*d* are checked. For example, the solenoid valve 12*a* and the solenoid valve 12*c* are opened and the solenoid valve 11*a* and the solenoid valve 11*c* are dosed such that a heating flow is created, and the refrigerant temperatures of the use units 303*a* to 303*d* are checked.

In FIG. 3 with adequate wiring, it is recognized that the set branch port of the use unit 303*a* is the branch port 15*a* and the branch port 16*a* and the set branch port of the use unit 303*c* is branch port 15*c* and branch port 16*c*. At this time, the solenoid valves corresponding to the set branch port of the use unit 303*a*, namely, the solenoid valve 12*a* is opened and the solenoid valve 11*a* is closed to create a heating flow, and the solenoid valves corresponding to the set branch port of the use unit 303*c*, namely, the solenoid valve 12*c* is opened and the solenoid valve 11*c* is closed to create a heating flow. Since the refrigerant temperatures of the use unit 303*a* and the use unit 303*c* change to refrigerant temperatures of a heating flow, the unit controller 101 determines that there is correspondence between the branch ports connected by refrigerant pipes and the set branch ports obtained from the wiring connection.

In contrast, in FIG. 4 with inadequate wiring, it is recognized that the set branch port of the use unit 303*b* is the branch port 15*c* and the branch port 16*c* and the set branch port of the use unit 303*c* is the branch port 15*b* and the branch port 16*b*. At this time, even if the solenoid valves that correspond to the set branch port of the use unit 303*b*, namely, the solenoid valve 12*c* is opened and the solenoid valve 11*c* is dosed to create a heating flow, the use unit 303*b* is fix to a refrigerant temperature of the cooling flow. From this, the unit controller 101 determines that there is non-correspondence between the branch ports connected by refrigerant pipes and the set branch ports obtained from the wiring connection. Note that, in the example in FIG. 4, since in the use unit 303*c*, the refrigerant temperature is that of a heating flow while it would be a temperature of the cooling flow if it were connected adequately, it can be detected that the wire connection of the transmission lines of the use unit 303*b* and the use unit 303*c* are wrong, thus enabling specification of the location of the inadequate wiring.

The change of operating states is determined by whether the refrigerant temperature is that of a cooling flow or that of a heating flow.

In each of the use units 303*a* to 303*d*, the refrigerant temperature can be determined that it is of a cooling flow when the detection temperature of the corresponding one of the temperature sensors 205*a* to 205*d*, which are temperatures of the low-pressure two-phase refrigerant, is equivalent to or lower than the detection temperature of the respective one of the temperature sensors 207*a* to 207*d*, which are temperatures of the air.

Further, each of the refrigerant temperatures can be determined that it is of a heating flow when the detection temperature of each of the temperature sensors 205*a* to 205*d*, which are temperatures of the high-pressure liquid refrigerant, is equivalent to or higher than the detection temperature of the corresponding one of the temperature sensors 207*a* to 207*d*, which are temperatures of the air.

Here, the detection temperatures of the temperature sensors 205*a* to 205*d* acts as liquid side temperatures of the use side heat exchangers 9*a* to 9*d*, respectively. Note that the method of determining the change in the operating state of the use units 303*a* to 303*d* is not limited to the above-described method. For example, the detection temperatures of the temperature sensors 205*a* to 205*d* and the saturation temperature of the detection pressure of the pressure sensor 208, that is, the evaporating temperature, may be used, in which the determination is performed by determining how dose the temperatures of the temperature sensors 205*a* to 205*d* are to the evaporating temperature.

As above, the non-correspondence between the transmission lines and the refrigerant pipes can be detected with a single switching operation of the solenoid valves.

Now, the capacity of the use units 303*a* to 303*d* connected to the multi air-conditioning apparatus 100 will be discussed. It is not so common that the capacities of the use units 303*a* to 303*d* of the multi air-conditioning apparatus 100 are all the same; there are cases in which the capacities of the use units 303*a* to 303*d* each differ based on the piece of real estate.

Although it is possible to detect if there is a non-correspondence between the transmission lines and the refrigerant pipes by changing the flow of the refrigerant in every other one of the branch ports, depending on the capacity of the use unit 303 that switches the flow of the refrigerant, there may be cases in which an abnormal operation is occurs.

For example, let the capacity of the heat source unit 301 be 10 horsepower (HP), that of the use unit 303*a* be 5 HP, that of the use unit 303*b* be 1 HP, that of the use unit 303*c* be 3 HP, and that of the use unit 303*d* be 1 HP.

In such a case, when the use unit 303*a* and the use unit 303*c* are switched from the cooling flow to the heating flow at the same time during cooling only operation where all of the use units 303*a* to 303*d* are performing cooling operation, since the value of the total capacity of the evaporator (the use side heat exchangers 9 with the cooling flow) becomes 2 HP after the switching from 10 HP before switching, the pressure on the low-pressure side of the refrigeration cycle drops, leading to abnormal operation. This kind of abnormal operation may damage the components, thus is not desirable.

Accordingly, in Embodiment 1, abnormal operation is averted by performing a switching operation according to the operation method described below.

<Correspondence Determination Operation>

Figure 5:
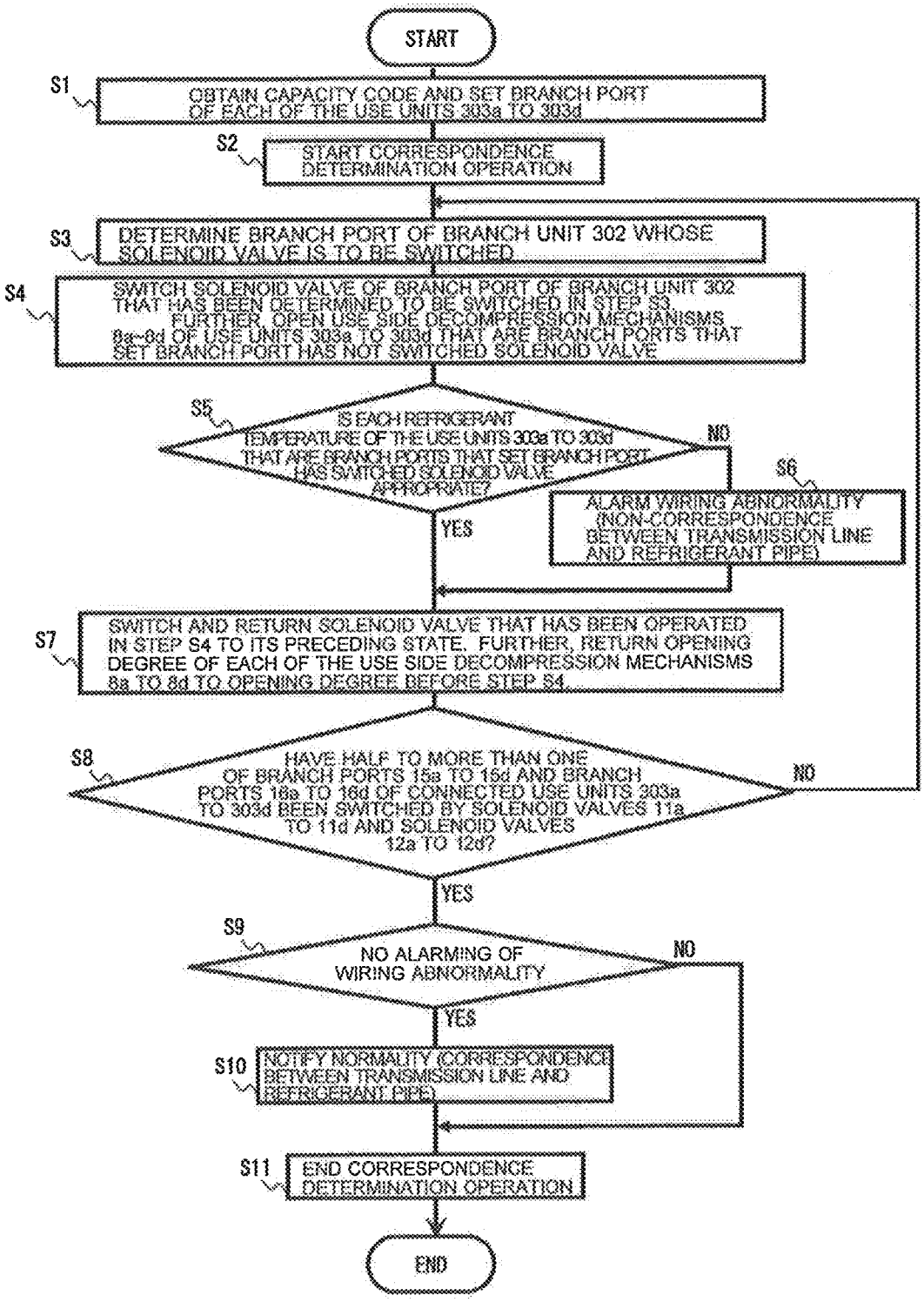
FIG. 5 is a flowchart for checking the correspondence between the refrigerant pipes and the transmission lines of the multi air-conditioning apparatus 100 of Embodiment 1.

FIG. 5 is a flowchart for checking the correspondence between the refrigerant pipes and the transmission lines of the multi air-conditioning apparatus 100 of Embodiment 1.

After installation work, the unit controller 101 performs an operation shown in the flowchart in FIG. 5 and checks the correspondence between the refrigerant pipes and the transmission lines.

In step S1, the unit controller 101 obtains a capacity code (use unit capacity) and the set branch port of each of the use units 303*a* to 303*d* and stores them in the storage unit 106. Note that the capacity code is a value that indicates the size of the capacity (HP) of each of the use units 303*a* to 303*d*, in which the capacity code becomes larger as the capacity becomes larger. A construction worker may input this information of the capacity code into the unit controller 101 or the information may be obtained from the use units 303*a* to 303*d* through the transmission line.

Next, in step S2, the control unit 104 starts the correspondence determination operation. Here, the correspondence determination operation is performed in a trial operation mode.

The trial operation mode performs a trial cooling only operation in which all of the use units 303*a* to 303*d* are in cooling operation or performs a trial heating only operation in which all of the use units 303*a* to 303*d* are in heating operation. Which to perform may be determined according to the outdoor air temperature or the like; for example, when the outdoor air temperature is 7° C. or higher, the trial cooling only operation may be performed and when the outdoor temperature is under 7° C., the trial heating only operation may be performed.

The trial operation mode will be described assuming that the trial cooling only operation is performed in the following description. That is, all of the use units 303*a* to 303*d* perform cooling operation, which is an operation state of the cooling only operation mode A. Accordingly, the solenoid valves 11*a* to 11*d* and solenoid valves 12*a* to 12*d* of all the branch ports are set to the cooling flow.

After elapse of a predetermined period of time, for example, after elapse of 15 minutes, in step S3, the control unit 104 determines the branch ports of the branch unit 302 that are to be switched to the heating flow. Note that the flow switching of each branch port is performed by the corresponding solenoid valves 11*a* to 11*d* and solenoid valves 12*a* to 12*d* that function as flow control valves.

Here, since wrong wiring of neighboring branch ports is to be detected, every other one of the branch ports will be made to operate the solenoid valves. At this time, if a use unit 303 with a large capacity is connected to a branch port that is to be switched, there is a possibility of abnormal operation due to drop of pressure on the low-pressure side after the switching. Accordingly, taking the capacities of the use units connected to the branch ports that are to be switched into consideration, the branch ports to be switched are determined with the method described below.

Figure 6:
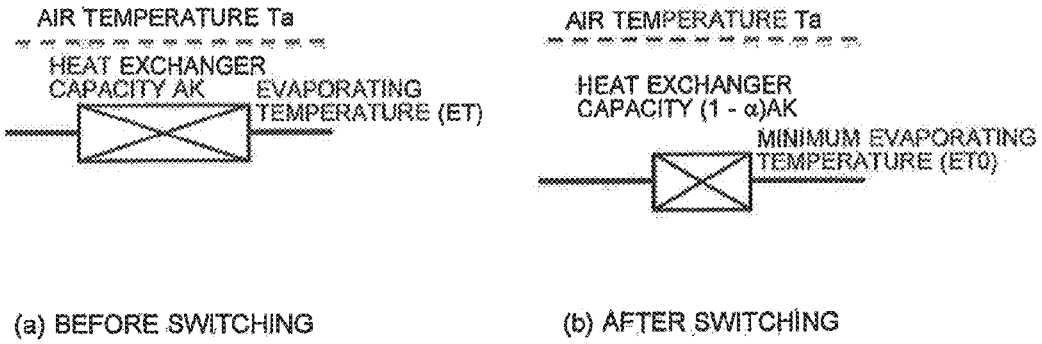
FIG. 6 is a schematic diagram illustrating a determination method of the number of switchable use units during a trial cooling operation of the multi air-conditioning apparatus 100 of Embodiment 1.

FIG. 6 is a schematic diagram illustrating a determination method of the number of switchable use units during a trial cooling operation of the multi air-conditioning apparatus 100 of Embodiment 1.

Assuming that the operating frequencies of the compressor 1 before and after the switching are fixed and that the quantity of evaporation heat before and after the switching are constant, the following equation holds true:

$$AK(Ta-ET)=(1-\alpha)AK(Ta-ET0) \quad (1)$$

Where, AK is the total capacity [KWK] of the heat exchangers of the use units 303*a* to 303*d*.

Ta is the mean air temperature [° C.] of the use units 303*a* to 303*d*, which is obtained with the detection temperatures of the temperature sensors 207*a* to 207*d* (use unit air temperature detection means).

ET is the evaporating temperature [° C.] before switching. Here, by setting ET to the saturation temperature of the detection pressure of the pressure sensor 208 (the refrigerant saturation temperature of the heat source unit), the switching position can be determined within the operating range of the compressor 1. Alternatively, by setting ET to the lowest temperature of the detection temperatures of the temperature sensors 205*a* to 205*d* of the use units 303*a* to 303*d* (refrigerant saturation temperature of the use unit), it will be possible to determine the switching position where the use side heat exchangers 9*a* to 9*d* of the use units 303*a* to 303*d* do not freeze. Note that the temperatures of the temperature sensors 205*a* to 205*d* are the liquid side temperatures of the use side heat exchangers 9*a* to 9*d*, and note that during trial cooling operation, the saturation temperature of the refrigerant in the use units 303*a* to 303*d* are detected. Further, note that in Embodiment 1, the saturation temperature of the pressure sensor 208 or the temperature sensors 205*a* to 205*d* acts as "refrigerant saturation temperature detection means" of the invention.

ET0 is the minimum evaporating temperature [° C.] within the range in which no abnormal operation occurs and is a set value that is stored in the storage unit 106 of the unit controller 101.

α is the operation switching capacity [-] of the use units.

In equation (1), since AK is present on both sides, they are canceled out; the operation switching capacity α can be obtained by Ta, ET, and ET0.

As it can be understood by the above, it will be possible to perform correspondence determination within the appropriate operation ranges of the compressor 1 and the use units 303*a* to 303*d* by determining the branch ports that are to switch the distribution direction of the refrigerant so that the operation switching capacity α is not exceeded.

Note that the air temperature of the use units 303*a* to 303*d* are not all the same; normally, the air temperature differs in each use unit 303.

Accordingly, the mean air temperature Ta is calculated as a weighted mean of the air temperatures of the use units 303*a* to 303*d*, where the weights are capacity of the use units 303*a* to 303*d*, for example. For example, assuming that use unit 303*a* has 5 HP with an air temperature of 20° C., the use unit 303*b* has 1 HP with an air temperature of 18° C., the use unit 303*c* has 3 HP with an air temperature of 22° C., and the use unit 303*d* has 1 HP with an air temperature of 21° C., then the following holds true:

$$Ta=(20\times5+18\times1+22\times3+21\times1)/(5+1+3+1)=20.5°\ C.$$

Specifically, since the number of the use units 303*a* to 303*d* with a cooling flow changes before and after the switching, each Ta is different; however, the same value is used assuming that the air temperature difference of each use units 303*a* to 303*d* is not so large during trial operation. Naturally, although the computation load will become higher, Ta after the switching may also be calculated. For example, when use unit 303*a* is switched, Ta after the switching will be as follows:

$$Ta=(18\times1+22\times3+21\times1)/(1+3+1)=21.0°\ C.$$

The drop of low pressure can be averted with more precision by performing this computing for each assumption of the number of units.

As for the other values, when assuming that the evaporating temperature ET before the switching (the evaporating temperature during trial cooling operation) is 12° C., the minimum evaporating temperature ET0 is 1° C. when anti-freezing of the use units 303 is taken into consideration, then from equation (1), α is 0.56. That is, in this example, the upper limit of the switching is 56% of the total capacity of the use units 303*a* to 303*d*. Accordingly, since the capacity of the use unit 303*a* is 5 HP and the capacity of the use unit 303*c* is 3 HP, when the two use units, the use unit 303*a* and the use unit 303*c*, are switched to have a heating flow at the same time, 80% of the total capacity of the use units 303*a* to 303*d* is switched, which is over 56%. On the other hand, when only one unit, the use unit 303*a*, is switched to have a heating flow so that the switching capacity is 50% of the total capacity, then it will be under 56% and abnormal operation can be averted.

Note that in the case of the wiring in FIG. 4, since the unit controller 101 recognizes the set branch port of the use unit 303*b* to be branch port 15*c* and the branch port 16*c*, in the determination performed by switching every other one of the branch ports, the use unit 303*a* and the use unit 303*b* are the target. In Embodiment 1, when the use unit 303*a* and the use unit 303*b* are switched to have heating flows, since 60% of the total capacity is switched and since it is over the operation switching capacity 56% of the operation of switching, only one unit, the use unit 303*a*, is switched to have a heating flow so that the switching capacity is 50% of the total capacity, thus averting abnormal operation.

Further, in equation (1), AK (Ta−ET) may be computed for before and after the switching of each use unit 303 without using the mean air temperature Ta.

In this case, the operation switching capacity α is obtained by increasing the number of use units 303*a* to 303*d* made to have the heating flow one by one until the computing of an evaporating temperature ET1 after the switching becomes equal to or lower than the minimum evaporating temperature ET0.

For example, in a case in which a single unit, the use unit 303*a*, is switched, when the heat exchanger capacity of the use unit 303*a* is AK1 and the air temperature is T1; the heat exchanger capacity of the use unit 303*b* is AK2 and the air temperature is T2; the heat exchanger capacity of the use unit 303*c* is AK3 and the air temperature is T3; and the heat exchanger capacity of the use unit 303*d* is AK4 and the air temperature is T4, then, the following is computed:

$$AK1(Ta1-ET)+AK2(Ta2-ET)+AK3(Ta3-ET)+AK4(Ta4-ET)=AK2(Ta2-ET1)+AK3(Ta3-ET1)+AK4(Ta4-ET1).$$

Since all of the values other than ET1 are known, ET1 can be obtained. At this time, since AK is an indicator of the heat exchange capacity of the use unit, the capacity code of the use units 303*a* to 303*d* may be directly substituted.

With the above, since the temperature difference between the refrigerant and the air can be considered in detail, it will be possible to further avert abnormal operation with more precision.

Further, in addition to the heat transfer during cooling operation, since mass transfer occurs during condensation of vapor in the air, the cooling capacity of each of the use units 303*a* to 303*d* is determined, strictly speaking, not by the difference in temperature but by the difference in enthalpy. Accordingly, by disposing a humidity sensor to each of the use units 303*a* to 303*d* and by creating an equation (1) regarding the air and refrigerant without using the temperature difference but with the enthalpy difference, it will be possible to avert abnormal operation with further higher precision.

As a method of performing switching of every other one of the branch ports, there is one in which the solenoid valve 11*b* and the solenoid valve 12*b*, and the solenoid valve 11*d* and the solenoid valve 12*d* are switched. That is, as the switching determination pattern, there are two patterns, namely, an odd numbered port operation pattern that performs determination on the basis of the first branch port (odd numbered branch port) and an even numbered port operation pattern that performs determination on the basis of the second branch port (even numbered branch port).

Whether to use the odd numbered branch port or the even numbered branch port as the base to perform the determination is determined as below. That is, the operation switching capacity α during the trial cooling operation is obtained and with this α, the "odd-numbered-branch-port valve operation number" which is the number of times of switching when the switching is started from the odd numbered branch port is obtained. Further, the "even-numbered-branch-port valve operation number" which is the number of times of switching when the switching is started from the even numbered branch port is obtained. Out of the odd-numbered-branch-port valve operation number and the even-numbered-branch-port valve operation number, the one with less number of times of switching will be the base to perform the switching operation.

For example, the operation is performed as below.

FIG. 7 is a schematic diagram illustrating a determination method of the base switching port that performs solenoid valve switching of the multi air-conditioning apparatus 100 of Embodiment 1.

When switching is started from the odd numbered branch ports, in order to perform switching so as not to exceed the operation switching capacity α, after switching only the use unit 303*a* to have a heating flow, the use unit 303*a* is returned to have a cooling flow, and then the use unit 303*c* alone is switched to have a heating flow. The number of switching of the odd numbered port operation pattern is twice.

On the other hand, when switching is started from the even numbered branch ports, since the use unit 303*b* and the use unit 303*d* both have 1 HP and the capacity during switching is 20%, even if the two units are switched at the same time, the operation switching capacity α will not be exceeded and it will not cause any abnormal operation. Accordingly, the number of switching of the even numbered port operation pattern is once.

As above, the switching number, that is, the period of time to finish the determination of the entire system differs between the pattern in which the determination is performed based on the odd numbered branch port and the pattern in which the determination is performed based on the even numbered branch port. In the current example, by performing the determination with the even numbered branch port as the base, the determination is finished by switching once, and the determination can be completed in a shorter time than that of the switching based on the odd numbered branch port.

Next, in step S4, the control unit 104 switches the solenoid valves of the branch ports of the branch unit 302 that have been determined in the above step S3.

Further, the opening degrees of the use side decompression mechanisms 8 of the use units 303 having the set branch ports whose solenoid valves have not been switched are increased in proportion to the ratio of the capacity of the switched use units.

The operation will be described in detail.

Figure 8:
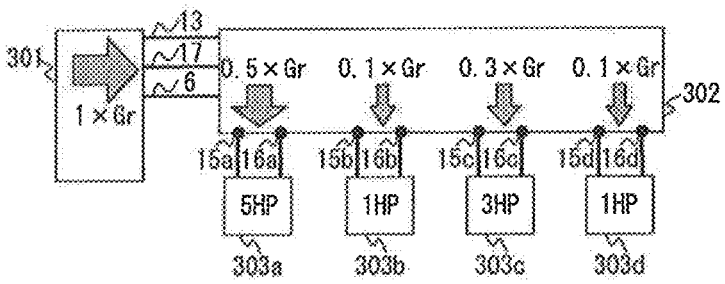
FIG. 8 is a schematic diagram illustrating the flowing state of an evaporative heat supply refrigerant to the use units 303*a* to 303*d* before switching of the solenoid valves during a correspondence determination operation of the multi air-conditioning apparatus 100 of Embodiment 1.

FIG. 8 is a schematic diagram illustrating the flowing state of an evaporative heat supply refrigerant to the use units 303*a* to 303*d* before switching of the solenoid valves during the correspondence determination operation of the multi air-conditioning apparatus 100 of Embodiment 1.

Figure 9:
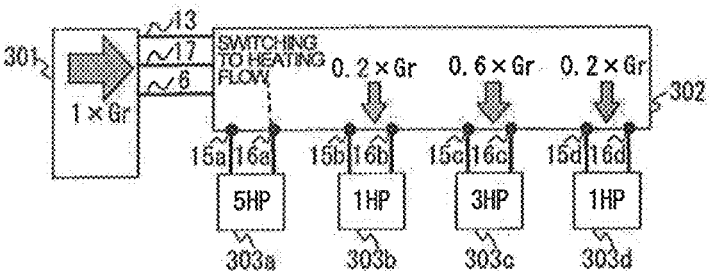
FIG. 9 is a schematic diagram illustrating the flowing state of an evaporative heat supply refrigerant to the use units 303*a* to 303*d* after switching of the solenoid valves during the correspondence determination operation of the multi air-conditioning apparatus 100 of Embodiment 1.

FIG. 9 is a schematic diagram illustrating the flowing state of an evaporative heat supply refrigerant to the use units 303*a* to 303*d* after switching of the solenoid valves during the correspondence determination operation of the multi air-conditioning apparatus 100 of Embodiment 1.

Referring to FIGS. 8 and 9, Gr represents the flow rate [kg/h] of the evaporative heat supply refrigerant. Further, the state of FIG. 9 after the solenoid valves have been switched is equivalent to the first odd numbered port based switching in FIG. 7 and is in a state in which the solenoid valve of the use unit 303*a* alone is switched.

In the state shown in FIG. 8 before the switching of the solenoid valve, since all of the use units 303*a* to 303*d* have a cooling flow, the flow rate [1×Gr] of the refrigerant flowing in from the heat source unit 301 is distributed in proportion to the capacity (HP) of each of the use units 303*a* to 303*d* and the opening degree of each of the use side decompression mechanisms 8*a* to 8*d* is in correspondence with the refrigerant flow rate.

Under this state, as shown in FIG. 9, when the branch port that is connected to the use unit 303*a* is switched to have a heating flow, the flow rate of the evaporative heat supply refrigerant [0.5×Gr] that had been flowing into the use unit 303*a* flows into the other use units 303*b* to 303*d*. Assuming that the Cv value (opening degree) of the use side decompression mechanisms 8*a* to 8*d* are increased in proportion to the capacity of each use unit, the refrigerant flow rate after the switching of the solenoid valves will be as follows.

In the use unit 303*b*, it will be [0.1+0.5×1/(1+3+1)]×Gr=0.2×Gr.

In the use unit 303*c*, it will be [0.3+0.5×1/(1+3+1)]×Gr=0.6×Gr.

In the use unit 303*d*, it will be [0.1+0.5×1/(1+3+1)]×Gr=0.2×Gr.

Note that a condensation heat supply refrigerant flows in the use unit 303*a* since it has a heating flow.

As above, since the refrigerant flow rate increases in the use units having the branch port whose solenoid valves have not been switched, if the opening degrees of the use side decompression mechanisms 8*a* to 8*d* are not increased in proportion to the increased amount of the flow rate, the pressure on the low pressure side will drop since it will be in a throttled state relative to the state before the switching of the solenoid valves.

Accordingly, the opening degrees of the use side decompression mechanisms 8*a* to 8*d* of the use units 303 having the set branch port whose solenoid valves have not been switched are increased on the basis of the value of the total capacity of the use units 303*a* to 303*d* and the value of the total capacity of the use units 303 having the set branch port whose solenoid valves have been switched.

The flow rate of the refrigerant flowing in each use unit 303 after the switching increases, with respect to the flow rate before the switching, in proportion to the ratio of the total capacity of the use units 303 having the cooling flow before the switching to the total capacity of the use units 303 having the cooling flow after the switching. Therefore, each opening degree of the use side decompression mechanism 8 after the switching is determined by the ratio of the total capacity of the use units 303*a* to 303*d* having the cooling flow before the switching to the total capacity of the use units 303*a* to 303*d* having the cooling flow after the switching.

That is, the opening degree of each use side decompression mechanism 8 of the use unit 303 having the set branch port whose solenoid valve is switched is increased on the basis of the value of the total capacity of the use units 303*a* to 303*d*—since all of the use units 303*a* to 303*d* have a cooling flow before the switching of the solenoid valves—and the total capacity of the "valve-operation set-branch-port use unit" that is the total capacity of the use units 303 having the set branch port whose solenoid valve is switched.

For example, assuming that the opening degree of the use unit 303*b* before switching is 200 pulses, since the total capacity of the use units is 5+1+3+1=10 and the total capacity of the valve-operation set-branch-port use unit is 5, the opening degree after the switching is 200×10/(10−5)=400 pulses.

Further, with the same approach, in the case of the second odd numbered port based switching in FIG. 7, since the use unit 303*c* alone has a heating flow and the total capacity of the valve-operation set-branch-port use unit is 3, the opening degree of the use unit 303*b* after the switching is 200×10/(10−3)=286 pulses.

As above, by changing the opening degree of each of the use side decompression mechanisms 8*a* to 8*d*, pressure becoming abnormal can be averted and a correspondence determination operation between the pipes and the transmission lines can be performed with high reliability.

After elapse of a predetermined period of time after preforming step S4, for example, after elapse of 3 minutes, in step S5, the determination unit 107 determines whether the refrigerant temperature of each use unit 303 having the set branch port whose solenoid valves have been switched is appropriate or not.

Here, since the solenoid valves has been switched from the cooling flow to the heating flow, it is determined that the refrigerant temperature is appropriate if the refrigerant temperature of each use unit 303 corresponding to the branch port whose solenoid valves have been switched is that of the heating flow and that the refrigerant temperature is not appropriate if the refrigerant temperature is still the temperature of the cooling flow.

When all of the refrigerant temperatures are appropriate in the use units 303 having the branch port whose solenoid valves have been switched, the process proceeds to step S7.

On the other hand, if there is a use unit 303 that is not appropriate, the process proceeds to step S7 after alarming wire abnormality (non-correspondence between the transmission line and the refrigerant pipe) in step S6.

In step 7, the control unit 104 returns the solenoid valves that have been operated in step S4 to its preceding state. That is, the solenoid valves 12*a* to 12*d* are closed and the solenoid valves 11*a* to 11*d* are opened.

Next, in step S8, the control unit 104 determines whether the solenoid valves 11*a* to 11*d* and the solenoid valves 12*a* to 12*d* have performed switching of the branch ports in the number of branch ports equivalent to or more than half the number of the connected use units 303*a* to 303*d* subtracted by one (half the connected number of units−one unit).

Since every other one of the solenoid valves 11*a* to 11*d* and the solenoid valves 12*a* to 12*d* are switched, when the correspondence in the branch port from the first to last branch unit 302 is checked, then, the solenoid valves in at least "the number of connected branch ports−one" branch ports are switched.

For example, assuming that the number of connected use unit 303 is five, the number of branch ports is five, and half the number of units is three, when the solenoid valves are switched based on the odd numbered port, since the solenoid valves in the branch ports 1, 3 and 5 are switched, the number of the switched branch ports is three. Further, when the solenoid valves are switched based on the even numbered port, since the solenoid valves in the branch ports 2 and 4 are switched, the number of the switched branch ports is two. Either case satisfies more than two that is "half the connected number of units−one unit".

If more than half the connected number of units−one unit have not been switched, the control unit 104 returns to step S3 again and determines, from a branch port next to the branch port that has been performed the switching evaluation, the branch ports of the branch unit 302 that are to be switched to have the heating flow.

On the other hand, when more than half the connected number of units−one unit have been switched, the control unit 104 determines whether a wiring abnormality alarm has been issued in step S9. If there has been no wiring abnormality alarm, the control unit 104 notifies normality (correspondence between the transmission lines and the refrigerant pipes) in step S10 and ends the correspondence determination operation in step S11.

Note that in the multi air-conditioning apparatus 100 according to Embodiment 1, non-correspondence between the refrigerant pipes and the transmission lines is detected. The refrigerant pipes are connected to the branch ports 15*a* to 15*d* and the branch ports 16*a* to 16*d* of the branch unit 302. Further, the set branch ports are determined by the connection states of the transmission lines to the wiring terminal blocks. Therefore, the detection of the non-correspondence between the refrigerant pipes and the transmission lines is equivalent to detection of the non-correspondence between the branch ports and the set branch ports.

The execution command of the correspondence determination and the display of the result are performed with, for example, a laptop or an external controller.

Figure 10:
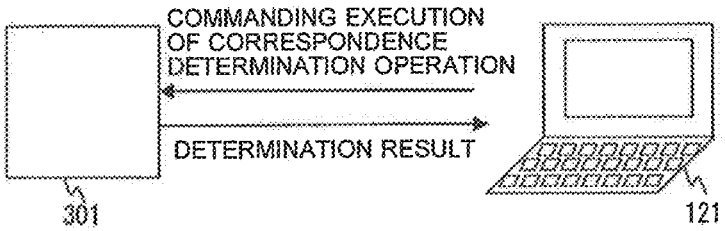
FIG. 10 is a schematic diagram illustrating methods of commanding execution of the correspondence determination operation and outputting the result of the multi air-conditioning apparatus 100 of Embodiment 1.

FIG. 10 is a schematic diagram illustrating a method of commanding execution of the correspondence determination operation and outputting the result of the multi air-conditioning apparatus 100 of Embodiment 1.

As shown in FIG. 10, with the laptop mounted with a controller control device 121, the execution command of the correspondence determination is input with the input unit 122 such as a keyboard and the input result is communicated from the external communication unit 123 to the unit communication unit 105 of the unit controller 101 that is mounted in the heat source unit 301. Subsequently, the multi air-conditioning apparatus 100 performs the correspondence determination shown in the flowchart of FIG. 5 and communicates the determination result to the external communication unit 123 of the controller control device 121 from the unit communication unit 105. Thereafter, the laptop displays the determination result on the display unit 124 such as a display. As for the determination result, all of the set branch ports that have been determined to be abnormal are displayed in the case of step S6 in which a wiring abnormality alarm has been issued, and a display indicating normality is displayed in the case of step S10 in which normality has been notified. With the above, it will be possible to perform the correspondence determination and obtain the result at a remote location from the unit.

Here, on the condensation heat side, when the solenoid valves of the branch ports of step S4 are switched, a portion of the condensation heat supply refrigerant is made to flow to the use unit 303 due to the switching of the solenoid valve.

For example, in the case of the first odd numbered port based switching in FIG. 7, with the switching of the use unit 303*a* to have a heating flow, the flow rate of the refrigerant flowing to the heat source side heat exchanger 3 is reduced then that before the switching and the pressure on the high-pressure side drops.

As a method of suppressing abnormal drop of pressure on the high-pressure side, there is one in which the use side decompression mechanism 8 of the use unit 303 of each of the branch port having a heating flow is throttled so as to secure the refrigerant flow rate of the heat source side heat exchanger 3. The opening degree of each use side decompression mechanism 8 after the switching of the solenoid valves may be obtained with the total capacity of the use units 303*a* to 303*d*, the total capacity of the valve-operation set-branch-port use unit that is the total capacity of the use units 303 having a heating flow after the switching, and the capacity of the heat source unit.

In the examples shown in FIGS. 8 and 9, the total capacity of the use units 303*a* to 303*d* is 5+1+3+1=10 HP, the total capacity of the use unit 303*a* having a heating flow after the switching is 5 HP, and the capacity of the heat source unit is 10 HP. Accordingly, when the opening degree of the use unit 303*a* before the switching is 300 pulses, then the opening degree after the switching is throttled to 300×10/(10+5)=200 pulses. With the above, excessive refrigerant flow to the use unit 303*a* is suppressed and a specified refrigerant flow rate is secured in the heat source side heat exchanger 3; hence, excessive drop of high pressure is prevented and the reliability of the correspondence determination operation is increased.

Even if the use side decompression mechanism 8 of the use unit 303 is throttled as above, since the high-pressure refrigerant that has been discharged from the compressor 1 is distributed to the use side heat exchanger 9, the flow rate of the refrigerant flowing in the heat source side heat exchanger 3 drops and the pressure on the high-pressure side drops accordingly. Hence, by reducing the heat exchange capacity of the heat source side heat exchanger 3, drop of pressure on the high pressure is averted. Note that the heat exchange capacity of the heat source side heat exchanger 3 is the heat exchange capacity AK of the heat source side heat exchanger 3.

Specifically, as a method to reduce the heat exchange capacity of the heat source side heat exchanger 3, the rotation speed of the heat source side fan 4 is reduced and air volume passing through the heat source side heat exchanger 3 is reduced, for example. The reducing volume may be obtained with the total capacity of the valve-operation set-branch-port use unit and the capacity of the heat source unit.

In the examples in FIGS. 8 and 9, when the air volume of the heat source side fan is 185 L/min and the heat source unit has 10 HP, and assuming that the capacity of the heat exchanger is proportional to 0.2 power of the air volume, then the air volume after the switching may be reduced to $$185\times[10/(10+5)]^{(1/0.2)}=24\ \text{L/min}.$$

Further, in order to be capable of dealing with a case in which the air volume is small from before the switching of the solenoid valves, such as when the outdoor air temperature is low, the heat source side heat exchanger 3 may be divided into a plurality of passages and solenoid valves that independently opens and doses each passage may be mounted so that the opening and dosing of the solenoid valve allows division of the heat transfer area of the heat source side heat exchanger 3. Furthermore, both the reduction of air volume and division of the heat transfer area may be used.

As such, by reducing the heat exchange capacity of the heat source side heat exchanger 3 after the switching of the solenoid valves of the branch ports, drop of pressure on the high-pressure side is prevented and the reliability of the correspondence determination operation is increased.

In the above description, a case in which the trial operation mode is of a trial cooling only operation has been described.

For example, when the outdoor air temperature is low, such as when the outdoor air temperature is below 7° C., it is difficult to perform a cooling operation; hence, it will not be possible to perform the correspondence determination operation with the trial cooling only operation. In such a case, the correspondence determination operation is performed with a trial heating only operation. That is, all of the use units 303*a* to 303*d* perform heating operation, which is an operation state of the heating only operation mode B. Accordingly, the solenoid valves 11*a* to 11*d* and solenoid valves 12*a* to 12*d* of all the branch ports are set to the heating flow.

Since the operation content of the correspondence determination operation performed with the trial heating only operation is almost the same as that of the trial cooling only operation, the operation content will be described with reference to the flowchart in FIG. 5.

In step S1, the unit controller 101 obtains a capacity code and the set branch port of each of the use units 303*a* to 303*d* and stores them in the storage unit 106. In step S2, the control unit 104 starts the correspondence determination operation. Here, the trial heating only operation is performed as the correspondence determination operation.

After elapse of a predetermined period of time, in step S3, the control unit 104 determines the branch ports of the branch unit 302 that are to be switched to the cooling flow with the similar procedure to that of the trial cooling operation.

Here, since wrong wiring of neighboring branch ports is to be detected, every other one of the branch ports will be made to operate the solenoid valves. At this time, if a use unit 303 with a large capacity is connected to a branch port that is to be switched, there is a possibility of abnormal operation due to drop of pressure on the high-pressure side after the switching. Accordingly, taking the capacities of the use units connected to the branch ports that are to be switched into consideration, the branch ports to be switched are determined with the method described below.

Figure 11:
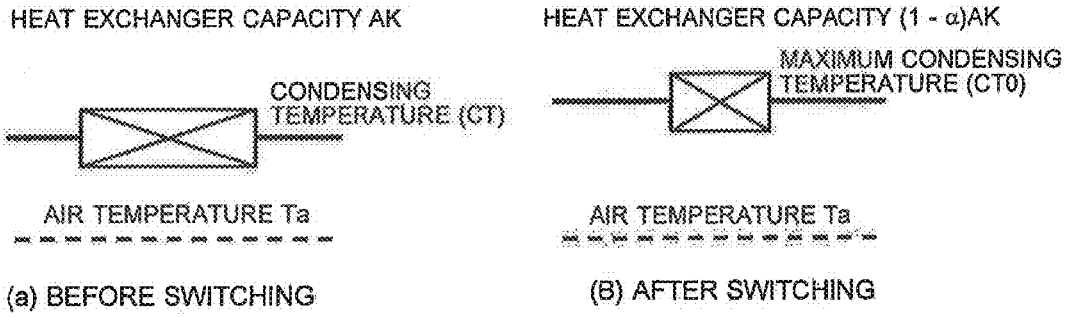
FIG. 11 is a flowchart illustrating a determination method of the number of switchable use units during a trial heating operation of the multi air-conditioning apparatus 100 of Embodiment 1.

FIG. 11 is a flowchart illustrating a determination method of the number of switchable use units during the trial heating operation of the multi air-conditioning apparatus 100 of Embodiment 1.

Assuming that the operating frequencies of the compressor 1 before and after the switching are fixed and that the quantity of condensation heat before and after the switching are constant, the following equation holds true:

$$AK(CT-Ta)=(1-\alpha)AK(CT0-Ta) \quad (2)$$

Where, AK is the total capacity [KWK] of the heat exchangers of the use units 303*a* to 303*d*.

Ta is the mean air temperature [° C.] of the use units 303*a* to 303*d*, which is obtained with the detection temperatures of the temperature sensors 207*a* to 207*d* (use unit air temperature detection means).

CT is the condensing temperature [° C.] before the switching and is a saturation temperature (refrigerant saturation temperature of the heat source unit) of the detection pressure of the pressure sensor 201 during the trial heating only operation.

CT0 is the minimum condensing temperature [° C.] within the range in which no abnormal operation occurs and is a set value that is stored in the storage unit 106 of the unit controller 101.

$\alpha$ is the operation switching capacity [-] of the use units.

In equation (2), since AK is present on both sides, they are canceled out; the operation switching capacity $\alpha$ can be obtained by Ta, CT, and CT0.

As it can be understood by the above, it will be possible to perform correspondence determination within appropriate operation ranges of the compressor 1 and the use units 303*a* to 303*d* by determining the branch ports that are to switch the distribution direction of the refrigerant so that the operation switching capacity $\alpha$ is not exceeded.

Note that the air temperature of the use units 303*a* to 303*d* are not all the same; normally, the air temperature differs in each use unit 303.

Accordingly, the mean air temperature Ta is calculated as a weighted mean of the air temperatures of the use units 303*a* to 303*d*, where the weights are capacity of the use units 303*a* to 303*d*, for example. For example, assuming that use unit 303*a* has 5 HP with an air temperature of 20° C., the use unit 303*b* has 1 HP with an air temperature of 18° C., the use unit 303*c* has 3 HP with an air temperature of 22° C., and the use unit 303*d* has 1 HP with an air temperature of 21° C., then the following holds true:

$$Ta=(20\times5+18\times1+22\times3+21\times1)/(5+1+1+3)=20.5^\circ\ \text{C.}$$

As for the other values, when assuming that the condensing temperature CT before the switching (the condensing temperature during trial heating operation) is 40° C., the maximum condensing temperature CT0 is 62° C. when the proper range of high pressure of the compressor 1 is taken into consideration, then from equation (2), $\alpha$ is 0.53. That is, in this example, the upper limit of the switching is 53% of the total capacity of the use units 303*a* to 303*d*; hence, by keeping the total capacity of the use units that are switched to have a cooling flow to be within 53%, the pressure on the high-pressure side will not rise and abnormal operation can be prevented.

Next, in step S4, the control unit 104 switches the solenoid valves of the branch ports of the branch unit 302 that have been determined in the above step S3.

Further, the opening degrees of the use side decompression mechanisms 8 of the use units 303 having the set branch ports whose solenoid valves have not been switched are increased in proportion to the ratio of the capacity of the switched use units.

After elapse of a predetermined period of time after preforming step S4, in step S5, the determination unit 107 determines whether the refrigerant temperature of each use unit 303 having the set branch port whose solenoid valves have been switched is appropriate or not.

Here, since the solenoid valves have been switched from the heating flow to the cooling flow, it is determined that the refrigerant temperature is appropriate if the refrigerant temperature of each use unit 303 corresponding to the branch port whose solenoid valves have been switched is that of the cooling flow and that the refrigerant temperature is not appropriate if the refrigerant temperature is still the temperature of the heating flow.

In the set branch ports, when all of the refrigerant temperatures are appropriate in the use units 303*a* to 303*d* having the branch port whose solenoid valves have been switched, the process proceeds to step S7.

On the other hand, if there is a use unit 303 that is not appropriate, the process proceeds to step S7 after alarming wire abnormality (non-correspondence between the transmission line and the refrigerant pipe) in step S6.

In step 7, the control unit 104 returns the solenoid valves that have been operated in step S4 to its preceding state. That is, the solenoid valves 12*a* to 12*d* are dosed and the solenoid valves 11*a* to 11*d* are opened.

Next, in step S8, the control unit 104 determines whether the solenoid valves 11*a* to 11*d* and the solenoid valves 12*a* to 12*d* have performed switching of the branch ports in the number of branch ports equivalent to or more than half the number of the connected use units 303*a* to 303*d* subtracted by one (half the connected number of units−one unit).

Since every other one of the solenoid valves 11*a* to 11*d* and the solenoid valves 12*a* to 12*d* are switched, when the correspondence in the branch port from the first to last branch unit 302 is checked, then, the solenoid valves in at least "the number of connected branch ports−one" branch ports are switched.

If more than half the connected number of units−one unit have not been switched, the control unit 104 returns to step S3 again and determines, from a branch port next to the branch port that has been performed the switching evaluation, the branch ports of the branch unit 302 that are to be switched to have the heating flow.

On the other hand, when more than half the connected number of units−one unit have been switched, the control unit 104 determines whether a wiring abnormality alarm has been issued. If there has been no wiring abnormality alarm, the control unit 104 notifies normality (correspondence between the transmission lines and the refrigerant pipes) in step S10 and ends the correspondence determination operation in step S11.

As such, even if there is a restriction in the operating state such that the trial cooling only operation cannot be performed, the non-correspondence between the refrigerant pipes and the transmission lines can be detected by performing the correspondence determination operation with the trial heating only operation.

Note that although in Embodiment 1, the number of use units 303 is four and that of the branch unit 302 is one, the invention is not limited to these numbers. The branch unit 302 may be of any number and any number of use units 303 may be connected to each branch unit 302; by performing the above-mentioned correspondence determination operation, determination of the location of the non-correspondence between the transmission lines and the refrigerant pipes can be performed.

<Connection State of Branch Port and Use Unit>

In the aforementioned description, the method of determining the correspondence between the refrigerant pipes and the transmission lines is described assuming that the number of branch ports and that of the use units 303 are the same; however, the correspondence between the branch ports and the use units is not necessarily one-to-one.

Figure 12:
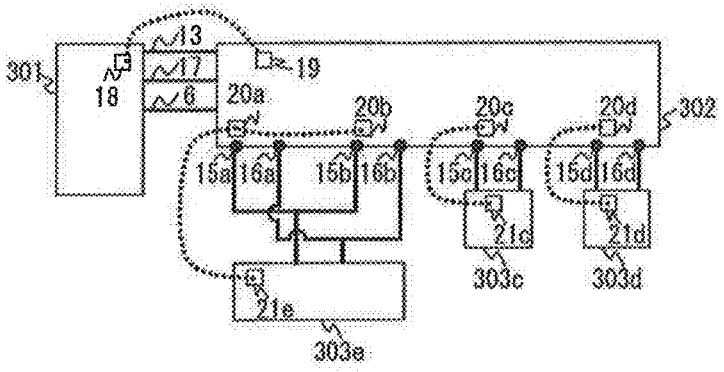
FIG. 12 illustrates a correspondence between the refrigerant pipes and the transmission lines when a large capacity use unit of the multi air-conditioning apparatus 100 of Embodiment 1 is connected.

As shown in FIG. 12, in a case in which the capacity of a use unit is large, such as a case in which the capacity of the use unit is 6 HP, the flow rate of the refrigerant in this use unit becomes high and the pipe resistance in one branch port becomes large. Accordingly, plural branch ports are connected to a single use unit 303 with refrigerant pipes. For example, a single large capacity use unit 303*e* is connected to a branch port 15*a*-15*b* and a branch port 16*a*-16*b*.

As regards the connection of the transmission lines in this case, the wiring terminal block 20*a* and the wiring terminal block 20*b* of the branch unit 302 and a wiring terminal block 21*e* of the large capacity use unit 303*e* are connected. The number of set branch ports of the use unit 303*e* is two, namely, the branch port 15*a*-15*b* and the branch port 16*a*-16*b*.

In the correspondence determination operation in this case, the set branch ports of the large capacity use unit 303*e* are treated as a single branch port and when switching the solenoid valves, all of the solenoid valves of the branch ports that are deemed to be a single branch port are switched. For example, in the case of FIG. 12, the number of branch ports of the branch unit 302 is deemed to be three, and when the solenoid valves of the branch port corresponding to the large capacity use unit 303*e* are switched, the solenoid valves of the two branch ports, namely, the solenoid valves 11*a* and 11*b* and solenoid valves 12*a* and 12*b*, are switched at the same time.

With the above, it will be possible to directly apply the aforementioned correspondence determination operation even to a case in which a plurality of branch ports is connected to a single use unit.

Figure 13:
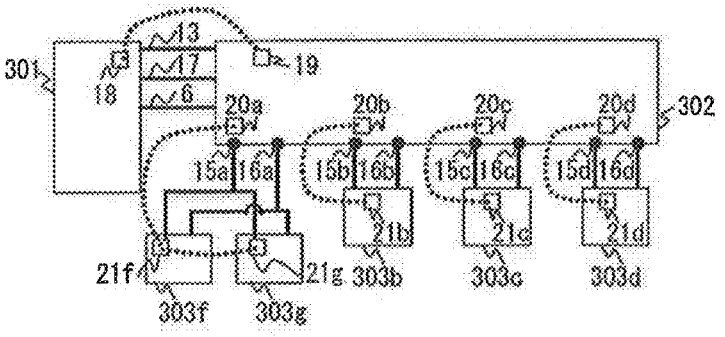
FIG. 13 illustrates a correspondence between the refrigerant pipes and the transmission lines when small capacity use units of the multi air-conditioning apparatus 100 of Embodiment 1 are connected.

Further, as shown in FIG. 13, in a case in which the capacity of the use unit is small, since the flow rate of the refrigerant in this use unit is low, a plurality of use units 303 is connected to a single branch port with refrigerant pipes. For example, two small capacity use units 303*f* and 303*g* are connected to the branch port 15*a* and the branch port 16*a*.

As regards the connection of the transmission lines in this case, the wiring terminal block 20*a* of the branch unit 302 is connected to a wiring terminal block 21*f* of the small capacity use unit 303*f* and a wiring terminal block 21*g* of the small capacity use unit 303*g*. The set branch port of both of the use unit 303*f* and the use unit 303*g* are branch port 15*a* and branch port 16*a* and are the same.

In the correspondence determination operation in this case, when opening the use side decompression mechanism 8 in step S4 of FIG. 5, the use side decompression mechanisms 8 of the plural use units 303 that are connected to the same branch port are opened with the same opening degree. For example, in a case in which the opening degree of the use side decompression mechanism 8*f* is 180 pulses and that of the use side decompression mechanism 8*g* is 190 pulses, when the opening degree of the use side decompression mechanism 8*f* is opened to 198 pulses by 10%, then the use side decompression mechanism 8*g* is opened to 209 pulses also by 10%.

Further, in step S8 of FIG. 5, the determination unit 107 regards the small capacity use units 303*f* and 303*g* that are connected to each of the single branch ports 15*a* and 16*a* as a single use unit 303 and performs the above described determination.

With this, it will be possible to directly apply the aforementioned correspondence determination operation even to a state in which a single branch port is connected to plural use units.

Furthermore, there are cases in which not all of the branch ports that are provided in the branch unit 302 are connected with a use unit 303. For example, there may be a case in which, among the four branch ports shown in FIG. 3, there is no use unit 303*b* and the piping ports of the branch port 15*b* and branch port 16*b* are closed with a stop valve or the like. Even in such a case, a transmission line may have been connected to the wiring terminal block 20*b* of the branch port that has been closed. Accordingly, similar to the case in which each of the branch ports 15*a* to 15*d* and the branch ports 16*a* to 16*d* is connected with a use unit 303, switching of every other one of the solenoid valves 11*a* to 11*d* and 12*a* to 12*d* are performed. As such, wrong wiring of the transmission line to a branch port that is not connected with a refrigerant pipe can be detected.

<Other Wiring Methods of Transmission Line>

Figure 14:
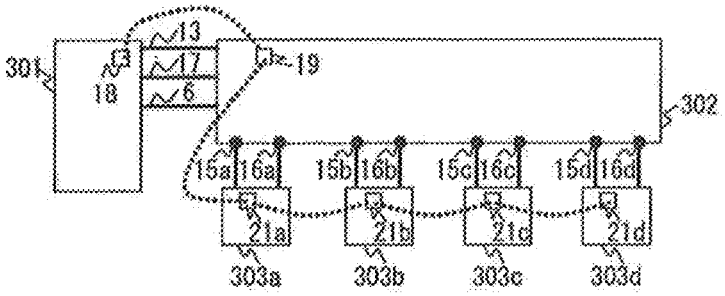
FIG. 14 is a wiring diagram 2 of the transmission lines of the multi air-conditioning apparatus 100 of Embodiment 1.

Other than the wiring method of the transmission line shown in FIG. 3, there is a method as shown in FIG. 14. Different from the wiring method of FIG. 3, in the wiring method of FIG. 14, the wire connection of the transmission line between the branch unit 302 and the use units 303*a* to 303*d* is carried out with the wiring terminal block 19 and the wire terminal blocks 21*a* to 21*d*.

With such wiring, it will be possible to perform wiring between the branch unit 302 and the use units 303 with a single transmission line and reduce the number of wiring lines. However, since there is a branch unit 302 that is not wire connected to a use unit 303, the unit controller cannot obtain the set branch ports from the wiring state. Accordingly, the set branch ports are manually set at the use units 303*a* to 303*d* with a DIP switch. Therefore, in the wiring method of FIG. 14, a non-correspondence also occurs between the branch ports and the set branch ports since the connection of the refrigerant pipes and the setting of the branch ports are performed separately.

By applying the correspondence determination operation of Embodiment 1 to this type of wiring method, it will be possible to perform early detection of the non-correspondence between the refrigerant pipes and the transmission lines; hence, reliability is increased.

Figure 15:
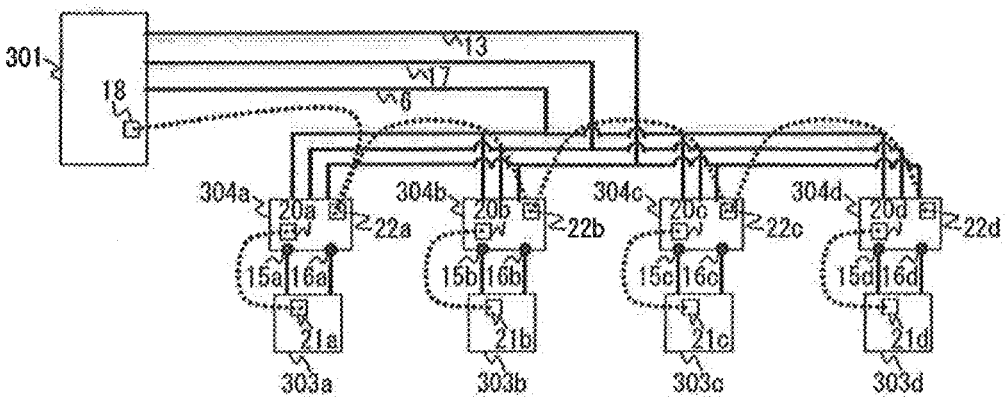
FIG. 15 is a wiring diagram 3 of the transmission lines of the multi air-conditioning apparatus 100 of Embodiment 1.

Further, as another wiring method, there is a wiring method as shown in FIG. 15. The system configuration of the wiring method of FIG. 15 is different to that of FIG. 3. In the example shown in FIG. 3, the use units 303*a* to 303*d* are branched from a single branch unit 302. In the example shown in FIG. 15, branching is performed with the liquid pipe 6, the low-pressure gas pipe 13, and the high-pressure gas pipe 17; each branch has a corresponding one of branch units 304*a* to 304*d*; and the branch units 304*a* to 304*d* and the use units 303*a* to 303*d* are respectively connected to each other with refrigerant pipes.

The branch unit 304*a* includes a solenoid valve 11*a* and a solenoid valve 12*a*, the branch unit 304*b* includes a solenoid valve 11*b* and a solenoid valve 12*b*, the branch unit 304*c* includes a solenoid valve 11*c* and a solenoid valve 12*c*, and the branch unit 304*d* includes a solenoid valve 11*d* and a solenoid valve 12*d*. The refrigerant pipe configuration of each of the branch units 304*a* to 304*d* is similar to the configuration of the single branch unit of the branch unit 302 shown in FIG. 3.

In the system configuration of FIG. 15, although the pipe length of the refrigerant pipes becomes long and the number of branch units become large, the number of wrong wirings of the transmission lines is deemed to be relatively less in number than the wiring method of FIG. 3 since each branch unit 304 is connected with only one use unit 303. However, in this wiring method as well, a non-correspondence occurs between the set branch ports and the pipes since the wire connection of the transmission lines (the setting of the branch ports) and the refrigerant pipe work are performed separately.

By applying the correspondence determination operation of Embodiment 1 to this type of wiring method, it will be possible to perform early detection of the non-correspondence between the refrigerant pipes and the transmission lines; hence, reliability is increased.

Embodiment 2

Configuration of Components

Figure 16:
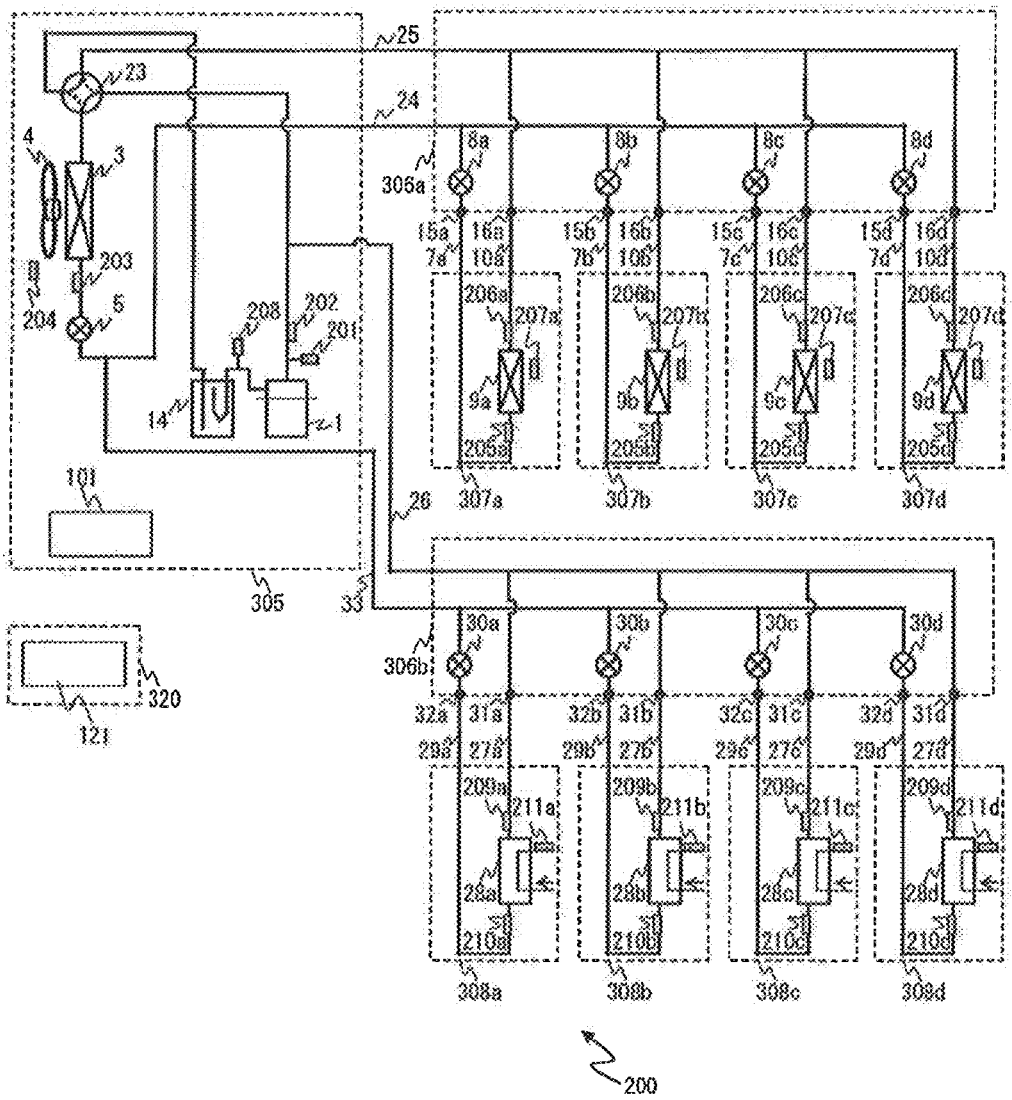
FIG. 16 is a refrigerant circuit diagram of a multi air-conditioning apparatus 200 of Embodiment 2.

FIG. 16 is a refrigerant circuit diagram of a multi air-conditioning apparatus 200 of Embodiment 2.

The multi air-conditioning apparatus 200 of Embodiment 2 is capable of performing a cooling operation or a heating operation in second use units 307*a* to 307*d* in accordance with a cooling command (cooling ON/OFF) or a heating command (heating ON/OFF) selected in the second use units 307*a* to 307*d*. Further, the multi air-conditioning apparatus 200 is capable of performing a hot water operation mode that heats water supplied to third use units 308*a* to 308*d* in accordance with a water heating command (hot water ON) from the third use side units 308*a* to 308*d*.

A refrigerant circuit configuration of the multi air-conditioning apparatus 200 of Embodiment 2 will be described with reference to FIG. 16. Note that the same components as those in Embodiment 1 are designated by the same reference numerals. The difference between Embodiment 1 will be mainly described.

In the multi air-conditioning apparatus 200 according to Embodiment 2, a second heat source unit 305 and a second branch unit 306*a* are connected by an air side pipe 24 and an air side pipe 25 that are refrigerant pipes. Further, the second heat source unit 305 and the second branch unit 306*b* are connected by a hot water side pipe 26 and a hot water side pipe 33 that are refrigerant pipes.

The second branch unit 306*a* and the second use unit 307*a* are connected with a liquid pipe 7*a* and a gas pipe 10*a* that are refrigerant pipes at branch port 15*a* and branch port 16*a*, respectively.

The second branch unit 306*a* and the second use unit 307*b* is connected with a liquid pipe 7*b* and a gas pipe 10*b* that are refrigerant pipes at branch port 15*b* and branch port 16*b*, respectively.

The second branch unit 306*a* and the second use unit 307*c* is connected with a liquid pipe 7*c* and a gas pipe 10*c* that are refrigerant pipes at branch port 15*c* and branch port 16*c*, respectively.

The second branch unit 306*a* and the second use unit 307*d* is connected with a liquid pipe 7*d* and a gas pipe 100*d* that are refrigerant pipes at branch port 15*d* and branch port 16*d*, respectively.

The second branch unit 306*b* and the third use unit 308*a* are connected with a gas pipe 27*a* and a liquid pipe 29*a* that are refrigerant pipes at branch port 31*a* and branch port 32*a*, respectively.

The second branch unit 306*b* and the third use unit 308*b* are connected with a gas pipe 27*b* and a liquid pipe 29*b* that are refrigerant pipes at branch port 31*b* and branch port 32*b*, respectively.

The second branch unit 306*b* and the third use unit 308*c* are connected with a gas pipe 27*c* and a liquid pipe 29*c* that are refrigerant pipes at branch port 31*c* and branch port 32*c*, respectively.

The second branch unit 306*b* and the third use unit 308*d* are connected with a gas pipe 27*d* and a liquid pipe 29*d* that are refrigerant pipes at branch port 31*d* and branch port 32*d*, respectively.

<Second Heat Source Unit 305>

The second heat source unit 305 is provided with a four-way valve 23 in place of the three-way valve 2 of the heat source unit 301 of Embodiment 1. Further, as shown in FIG. 16, the refrigerant pipe configuration in the second heat source unit 305 is such that either an evaporative heat supply refrigerant or a condensation heat supply refrigerant is allowed to be distributed to the second branch unit 306*a* and that only the condensation heat supply refrigerant is allowed to be distributed to the second branch unit 306*b*.

The four-way valve 23 has first to fourth ports in which the first port is connected to the discharge side of the compressor 1, the second port is connected to the heat source side heat exchanger 3, the third port is connected to the suction side of the compressor 1, and the fourth port is connected to the air side pipe 25. The four-way valve 23 is configured such that its setting can be switched between a state in which the first port and the second port are in communication with each other while the third port and the fourth port are in communication with each other (a state indicated by a solid line in FIG. 16) and a state in which the second port and the third port are in communication with each other while the first port and the fourth port are in communication with each other (a state indicated by a broken line in FIG. 16).

<Second Branch Unit 306*a*, Second Branch Unit 306*b*>

The second branch unit 306*a* includes use side decompression mechanisms 8*a* to 8*d* that allow variable distribution of the refrigerant to the branch ports 15*a* to 15*d* and the branch ports 16*a* to 16*d*.

The use side decompression mechanisms 8*a* to 8*d* are disposed so that their number corresponds to that of the branch ports 15*a* to 15*d* and the branch ports 16*a* to 16*d* of the second branch unit 306*a*.

Each of the use side decompression mechanisms 8*a* to 8*d* acts as a flow control valve.

Further, the second branch unit 306*a* acts as a pipe branch unit that connects the second heat source unit 305 and the second use units 307*a* to 307*d* with refrigerant pipes.

The second branch unit 306*b* includes hot water side decompression mechanisms 30*a* to 30*d* that allow variable distribution of the refrigerant to the branch ports 31*a* to 31*d* and the branch ports 32*a* to 32*d*. The hot water side decompression mechanisms 30*a* to 30*d* are disposed so that their number corresponds to that of the branch ports 31*a* to 31*d* and the branch ports 32*a* to 32*d* of the second branch unit 306*b*.

Each of the hot water side decompression mechanisms 30*a* to 30*d* acts as a flow control valve.

Further, the second branch unit 306*b* acts as a pipe branch part that connects the second heat source unit 305 and the third use units 308*a* to 308*d* with refrigerant pipes.

<Second Use Units 307*a* to 307*d*>

The second use units 307*a* to 307*d* are configured such that the use side decompression mechanisms 8*a* to 8*d* are removed from the use units 303*a* to 303*d* of Embodiment 1.

<Third Use Units 308*a* to 308*d*>

The third use units 308*a* to 308*d* includes water plate heat exchangers 28*a* to 28*d*, respectively. Each of the water plate heat exchangers 28*a* to 28*d* is a heat exchanger constituted by multiple plates and exchanges heat between water and a refrigerant.

Further, in the third use units 308*a* to 308*d*, temperature sensors 210*a* to 210*d* are provided on the liquid side of the water plate heat exchangers 28*a* to 28*d*, respectively, and temperature sensors 209*a* to 209*d* are provided on the gas side of the water plate heat exchangers 28*a* to 28*d*, respectively, each measuring the refrigerant temperature at their disposed positions.

Furthermore, in the third use units 308*a* to 308*d*, temperature sensors 211*a* to 211*d* are provided in the outlet of the water plate heat exchangers, respectively, and measure the water temperature in each of their disposed positions.

<Operation Modes>

The multi air-conditioning apparatus 200 controls each of the components mounted in the second heat source unit 305, the second branch units 306*a* and 306*b*, the second use units 307*a* to 307*d*, and the third use units 308*a* to 308*d* in accordance with the demanded air conditioning load of the second use units 307*a* to 307*d* and the demanded hot water load of the third use units 308*a* to 308*d*. For example, the multi air-conditioning apparatus 200 is capable of performing a second cooling only operation mode C, a second heating only operation mode D, and a hot water only operation mode E. Operation action of each operation mode will be described.

First, description will be given on the second cooling only operation mode C.

In the second cooling only operation mode C, the four-way valve 23 connects the discharge side of the compressor 1 to the gas side of the heat source side heat exchanger 3 and connects the suction side of the compressor 1 to the air side pipe 25. Further, the opening degree of the heat source side decompression mechanism 5 is at its maximum (fully opened). Furthermore, the opening degree of the hot water side decompression mechanisms 30*a* to 30*d* are at their minimum (totally closed) so as to be in a state in which no refrigerant flows into the second branch unit 306*b*.

A high-temperature high-pressure gas refrigerant discharged from the compressor 1 flows into the heat source side heat exchanger 3 through the four-way valve 23 and turns into a high-pressure liquid refrigerant by rejecting heat to the outdoor air that has been sent from the heat source side fan 4. Then, the high-pressure liquid refrigerant flows out of the heat source side heat exchanger 3 and flows into the heat source side decompression mechanism 5. Then, the high-pressure liquid refrigerant flows out of the second heat source unit 305 and flows into the second branch unit 306*a* through the air side pipe 24. The high-pressure liquid refrigerant is then decompressed by the use side decompression mechanisms 8*a* to 8*d* and turns into a low-pressure two-phase refrigerant. Subsequently, the two-phase refrigerant flows out of the second branch unit 306*a* through the branch ports 15*a* to 15*d*.

The two-phase refrigerant then flows into the second use units 307*a* to 307*d* through the liquid pipes 7*a* to 7*d*, respectively and turns into a low-pressure gas refrigerant while cooling the indoor air in the use side heat exchangers 9*a* to 9*d*. Then, the low-pressure gas refrigerant flows out of the second use units 307*a* to 307*d* and flows into the second branch unit 306*a* from the branch ports 16*a* to 16*d* through the gas pipes 10*a* to 10*d*.

The low-pressure gas refrigerant then flows out of the second branch unit 306*a*, flows into the second heat source unit 305 through the air side pipe 25, flows through the accumulator 14 via the four-way valve 23, and is sucked into the compressor 1 again.

Note that the opening degree of each of the use side decompression mechanisms 8*a* to 8*d* is controlled so that the degree of superheat in the corresponding one of the use side heat exchangers 9*a* to 9*d* becomes a predetermined value. Further, the operating frequency of the compressor 1 is controlled so that the evaporating temperature becomes a predetermined value, in which the evaporating temperature is a saturated gas temperature of the detection pressure of the pressure sensor 208. Further, the heat source side fan 4 is controlled so that the condensing temperature becomes a predetermined value, in which the condensing temperature is a saturated gas temperature of the pressure detected by the pressure sensor 201.

Next, description will be given on the second heating only operation mode D.

In the second heating only operation mode D, the four-way valve 23 connects the gas side of the heat source side heat exchanger 3 to the suction side of the compressor 1 and connects the air side pipe 25 to the discharge side of the compressor 1. Further, the opening degree of the heat source side decompression mechanism 5 is at its maximum (fully opened). Furthermore, the opening degree of the hot water side decompression mechanisms 30*a* to 30*d* are at their minimum (totally closed) so as to be in a state in which no refrigerant flows into the second branch unit 306*b*.

A high-temperature high-pressure gas refrigerant discharged from the compressor 1 flows out of the second heat source unit 305 through the four-way valve 23 and flows into the second branch unit 306*a* through the air side pipe 25. Subsequently, the refrigerant flows out of the second branch unit 306*a* through the branch ports 16*a* to 16*d*.

The high-temperature high-pressure gas refrigerant then flows into the second use units 307*a* to 307*d* through the gas pipes 10*a* to 10*d*, respectively, and flows into the use side heat exchangers 9*a* to 9*d*, respectively, and turns into a high-pressure liquid refrigerant while heating the indoor air. Then, the high-pressure liquid refrigerant flows out of the second use units 307*a* to 307*d* and flows into the second branch unit 306*a* from the branch ports 15*a* to 15*d* through the liquid pipes 7*a* to 7*d*. The high-pressure liquid refrigerant is then decompressed by the use side decompression mechanisms 8*a* to 8*d* and turns into a low-pressure two-phase refrigerant.

Then, the low-pressure two-phase refrigerant flows out of the second branch unit 306*a* and flows into the second heat source unit 305 through the air side pipe 24. The low-pressure two-phase refrigerant then passes through the heat source side decompression mechanism 5, flows into the heat source side heat exchanger 3, and turns into a low-pressure gas refrigerant while removing heat from the outdoor air blown from the heat source side fan 4. The low-pressure gas refrigerant flows out of the heat source side heat exchanger 3, passes through the accumulator 14 via the four-way valve 23, and is sucked into the compressor 1 again.

Note that the opening degree of each of the use side decompression mechanisms 8*a* to 8*d* is controlled so that the degree of subcooling in the corresponding one of the use side heat exchangers 9*a* to 9*d* becomes a predetermined value. Further, the operating frequency of the compressor 1 is controlled so that the condensing temperature becomes a predetermined value, in which the condensing temperature is a saturated gas temperature of the detection pressure of the pressure sensor 201. Further, the heat source side fan 4 is controlled so that the evaporating temperature becomes a predetermined value, in which the evaporating temperature is a saturated gas temperature of the pressure detected by the pressure sensor 208.

Next, description will be given on the hot water only operation mode E.

In the hot water only operation mode E, the four-way valve 23 connects the gas side of the heat source side heat exchanger 3 to the suction side of the compressor 1 and connects the air side pipe 25 to the discharge side of the compressor 1. Further, the opening degree of the heat source side decompression mechanism 5 is at its maximum (fully opened). Furthermore, the opening degree of the use side decompression mechanisms 8*a* to 8*d* are at their minimum (totally dosed) so as to be in a state in which no refrigerant flows into the second branch unit 306*a*.

A high-temperature high-pressure gas refrigerant discharged from the compressor 1 flows out of the second heat source unit 305 and flows into the second branch unit 306*b* through the hot water side pipe 26. Then, the high-temperature high-pressure gas refrigerant flows out of the branch ports 31*a* to 31*d* and flows into the third use units 308*a* to 308*d* through the gas pipes 27*a* to 27*d*, respectively.

The high-temperature high-pressure gas refrigerant then flows into the water plate heat exchangers 28*a* to 28*d* and turns into a high-pressure liquid refrigerant while heating the hot water. Then, the high-pressure liquid refrigerant flows out of the third use units 308*a* to 308*d* and flows into the second branch unit 306*b* from the branch ports 32*a* to 32*d* through the liquid pipes 29*a* to 29*d*. The high-pressure liquid refrigerant is then decompressed in the hot water side decompression mechanisms 30*a* to 30*d* and turns into a low-pressure two-phase refrigerant, flows out of the second branch unit 306*b*, and flows into the second heat source unit 305 through the hot water side pipe 33.

The low-pressure two-phase refrigerant then passes through the heat source side decompression mechanism 5, flows into the heat source side heat exchanger 3, and turns into a low-pressure gas refrigerant while removing heat from the outdoor air blown from the heat source side fan 4. The low-pressure gas refrigerant flows out of the heat source side heat exchanger 3, passes through the accumulator 14 via the four-way valve 23, and is sucked into the compressor 1 again.

Note that the opening degree of each of the hot water side decompression mechanisms 30*a* to 30*d* is controlled so that the degree of subcooling in the corresponding one of the water plate heat exchangers 28*a* to 28*d* becomes a predetermined value. The degree of subcooling in each of the water plate heat exchangers 28*a* to 28*d* is a value obtained by subtracting a temperature detected by the corresponding one of the temperature sensors 205*a* to 205*d* from a saturated liquid temperature detected by the pressure sensor 201. Further, the operating frequency of the compressor 1 is controlled so that the condensing temperature becomes a predetermined value, in which the condensing temperature is a saturated gas temperature of the detection pressure of the pressure sensor 201. Further, the heat source side fan 4 is controlled so that the evaporating temperature becomes a predetermined value, in which the evaporating temperature is a saturated gas temperature of the pressure detected by the pressure sensor 208.

As above, in the multi air-conditioning apparatus 200, each of the second use units 307*a* to 307*d* is capable of performing a cooling operation in which air is cooled by the evaporative heat supply refrigerant and is capable of performing a heating operation in which air is heated by the condensation heat supply refrigerant by controlling each of the components of the second heat source unit 305 and the second branch unit 306*a*. Further, each of the third use units 308*a* to 308*d* is capable of performing hot water operation in which water is heated by the condensation heat supply refrigerant by controlling each of the components of the second heat source unit 305 and the second branch unit 306*b*.

<Connection of Transmission Line During Installation Work>

In the multi air-conditioning apparatus 200 of Embodiment 2, in order to communicate the operating state and the operation mode of the second use units 307*a* to 307*d* and the third use units 308*a* to 308*d* and to communicate the operation command of the components, transmission signal lines (transmission lines) are connected between the second heat source unit 305 and the second branch unit 306*a*, the second branch unit 306*a* and the second use units 307*a* to 307*d*, the second branch unit 306*a* and the second branch unit 306*b*, and the second branch unit 306*b* and the third use units 308*a* to 308*d*.

Figure 17:
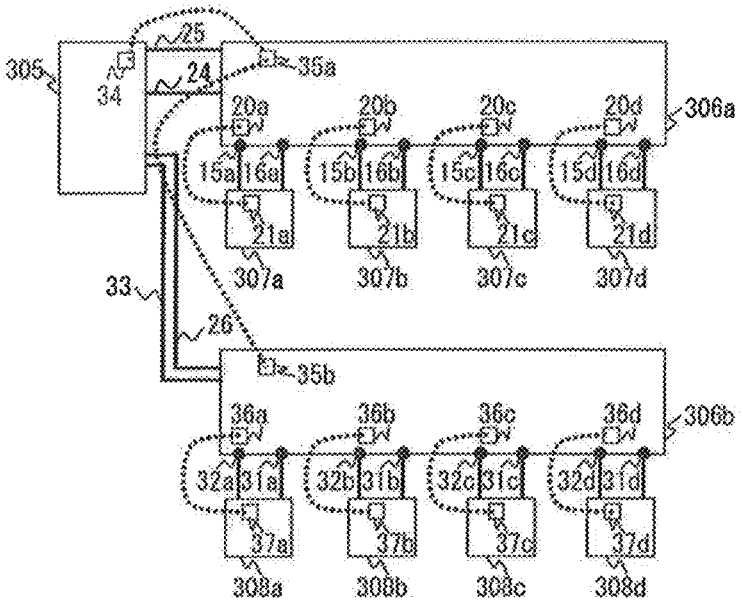
FIG. 17 is a wiring diagram of transmission lines of the multi air-conditioning apparatus 200 of Embodiment 2.

FIG. 17 is a wiring diagram of the transmission lines of the multi air-conditioning apparatus 200 of Embodiment 2.

In the wire connection shown in FIG. 17, a wiring terminal block 34 of the second heat source unit 305 and a wiring terminal block 35*a* of the second branch unit 306*a* are connected with a transmission line. Further, wiring terminal blocks 20*a* to 20*d* of the second branch unit 306*a* and wiring terminal blocks 21*a* to 21*d* of each of the second use units 307*a* to 307*d* are connected to each other, respectively. In the second branch unit 306*a*, the wiring terminal block 35*a* is connected to each of the wiring terminal blocks 20*a* to 20*d*.

Further, a wiring terminal block 35*a* of the second branch unit 306*a* and a wiring terminal block 35*b* of the second branch unit 306*b* are connected with a transmission line. Furthermore, wiring terminal blocks 36*a* to 36*d* of the second branch unit 306*b* and wiring terminal blocks 37*a* to 37*d* of each of the third use units 308*a* to 308*d* are connected to each other, respectively. In the second branch unit 306*b*, the wiring terminal block 35*b* is connected to each of the wiring terminal blocks 36*a* to 36*d*.

With the above connection of the transmission lines, the unit controller 101 is connected to the second heat source unit 305, the second branch unit 306*a*, the second branch unit 306*b*, the second use units 307*a* to 307*d*, and the third use units 308*a* to 308*d*.

The unit controller 101 obtains, as set branch ports, information on which branch ports 15*a* to 15*d* and branch ports 16*a* to 16*d* are each of the second use units 307*a* to

307*d* is connected to by refrigerant piping from the connection state of the transmission lines.

In addition, the unit controller 101 determines which use side decompression mechanisms 8*a* to 8*d* are to be operated on the basis of the obtained set branch ports. Specifically, for example, when the command to the second use unit 307*c* is changed from stop to a cooling operation, then, in the second branch unit 306*a*, the use side decompression mechanism 8*c* is opened on the basis of information on the set branch port of the second use unit 307*c*. As such, the refrigerant flow of each of the second use units 307*a* to 307*d* is controlled with the corresponding one of the use side decompression mechanisms 8*a* to 8*d* of the second branch unit 306*a*.

The unit controller 101 obtains, as set branch ports, information on which branch ports 31*a* to 31*d* and branch ports 32*a* to 32*d* are each of the third use units 308*a* to 308*d* is connected to by refrigerant piping from the connection state of the transmission lines.

In addition, the unit controller 101 determines which hot water side decompression mechanisms 30*a* to 30*d* are to be operated on the basis of the obtained set branch ports. Specifically, when the command to the third use unit 308*c* is changed from stop to a hot water operation, then, in the second branch unit 306*b*, the hot water side decompression mechanism 30*c* is opened on the basis of information on the set branch port of the third use unit 308*c*. As such, the refrigerant flow of each of the third use units 308*a* to 308*d* is controlled with the corresponding one of the hot water side decompression mechanisms 30*a* to 30*d* of the second branch unit 306*b*.

When installation work is carried out on-site, the connection of the refrigerant pipes and connection of the transmission lines between each unit are carried out separately by construction workers. Accordingly, similar to the case of Embodiment 1, there are cases in which non-correspondence between the refrigerant pipes and the transmission lines in the branch ports occur due to a wire connection defect in the wire connection of the transmission lines between the second branch unit 306*a* and the second use units 307*a* to 307*d* or in the wire connection of the transmission line between the second branch unit 306*b* and the third use units 308*a* to 308*d*.

Since the unit controller 101 recognizes the set branch ports on the basis of the connection state of the transmission lines, when the above wire connection defect is carried out such that there are non-correspondences between the refrigerant pipes and the transmission lines, the proper decompression mechanism of the branch port will not be operated.

Accordingly, in the multi air-conditioning apparatus 200 of Embodiment 2 as well, by performing the correspondence determination operation, the presence of wrong wiring is checked; hence, it is useful in order to perform appropriate construction work.

<Correspondence Determination Operation>

The multi air-conditioning apparatus 200 of Embodiment 2 does not have a system configuration allowing the second use units 307*a* to 307*d* to perform simultaneous operation of cooling and heating. Thus, it is not possible to determine if a non-correspondence exists by switching the refrigerant flow direction of the use units to a cooling flow or a heating flow as in Embodiment 1.

Accordingly, in the multi air-conditioning apparatus 200 of Embodiment 2, the determination of non-correspondence between the pipes and the transmission lines are performed on the basis of the change in the operating state of the use unit when the opening state of the decompression mechanism is changed.

First, description will be given on the determination method of the correspondence between the second branch unit 306*a* and the second use units 307*a* to 307*d*.

Figure 18:
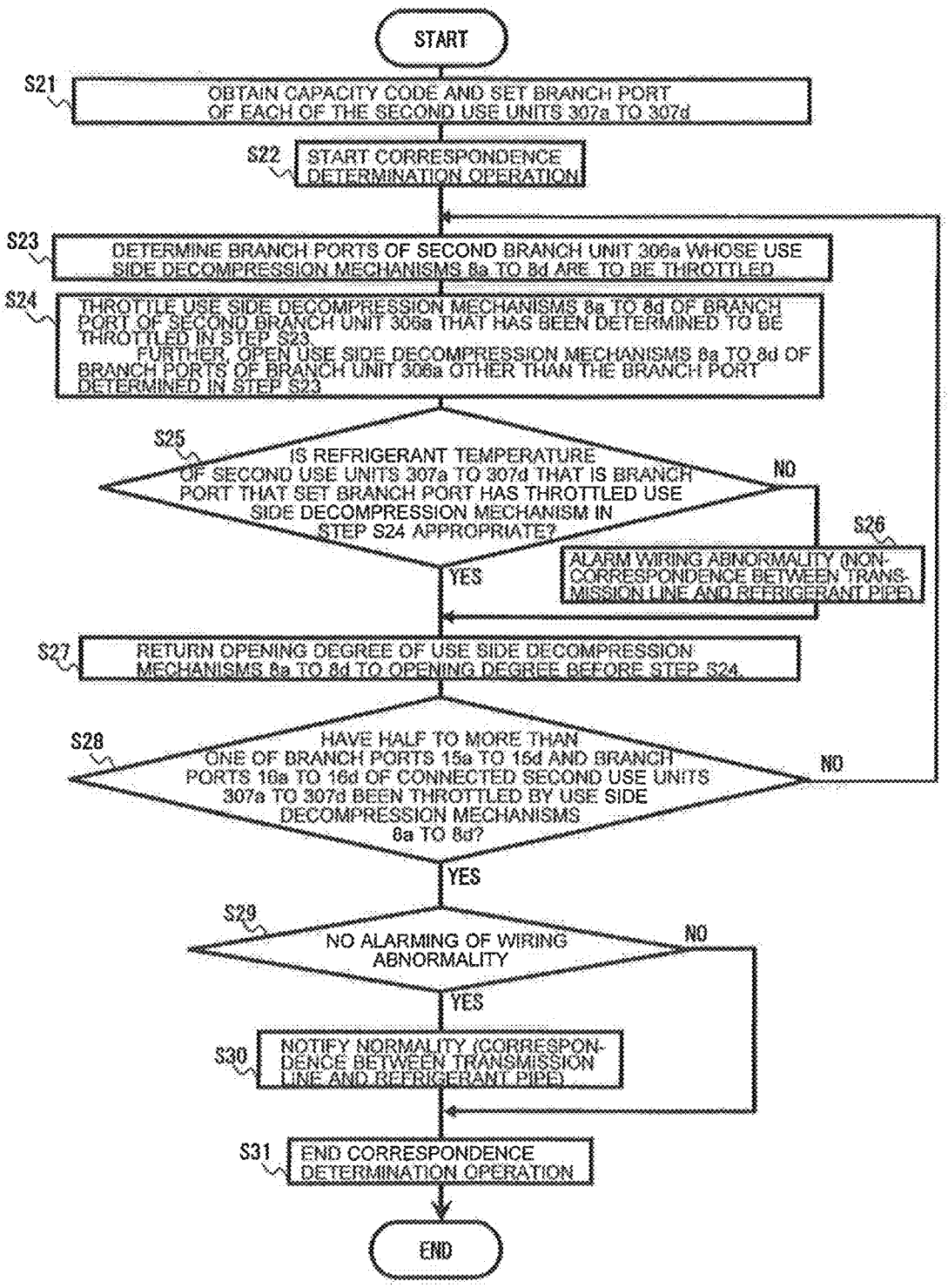
FIG. 18 is a flowchart for checking the correspondence between the transmission lines and the refrigerant pipes of the multi air-conditioning apparatus 200 of Embodiment 2.

FIG. 18 is a flowchart for checking the correspondence between the transmission lines and the refrigerant pipes of the multi air-conditioning apparatus 200 of Embodiment 2.

First, in step S21, the unit controller 101 obtains a capacity code and the set branch port of each of the second use units 307*a* to 307*d* and stores them in the storage unit 106.

Next, in step S22, the control unit 104 starts the correspondence determination operation. For example, when the correspondence determination is performed by a trial cooling only operation, the second cooling only operation mode C is carried out. Further, when the correspondence determination is performed by a trial heating only operation, the second heating only operation mode D is carried out.

The trial operation mode will be described assuming that the trial cooling only operation is performed in the following description.

After elapse of a predetermined period of time, in step S23, the control unit 104 determines, with a similar method to that of step S3 of Embodiment 1, the branch ports 15*a* to 15*d* and the branch ports 16*a* to 16*d* of the second branch unit 306*a* whose use side decompression mechanisms 8*a* to 8*d* functioning as a flow control valve are to be throttled.

Next, in step S24, the control unit 104 throttles the use side decompression mechanisms 8*a* to 8*d* of the branch port of the second branch unit 306*a* that has been determined in the above step S23. Here, each opening degree is throttled to its minimum opening degree (totally closed) such that no refrigerant flows therein.

Further, the opening degrees of other use side decompression mechanisms 8*a* to 8*d* are, with a similar method to that of step S4 of Embodiment 1, increased in proportion to the ratio of the capacity of each of the second use units 307 with the throttled use side decompression mechanism 8 (the second use units 307 that have operated the use side decompression mechanism 8 each acting as a flow control valve).

After elapse of a predetermined period of time after preforming step S24, in step S25, the determination unit 107 determines whether the refrigerant temperature of each second use units 307 having the branch port whose use side decompression mechanisms 8*a* to 8*d* have been throttled is appropriate or not.

Here, since each of the use side decompression mechanisms 8 is throttled until it is totally closed in the cooling flow, as regards the determination of whether appropriate or not, the refrigerant temperature is determined as appropriate if the refrigerant temperature of the second use unit 303 corresponding to the branch port whose use side decompression mechanism 8 has been throttled has increased and the refrigerant temperature is determined as not appropriate if the refrigerant temperature is still the temperature of the cooling flow. For example, if the refrigerant temperature is 2° C. below room temperature or higher, it is deemed that the refrigerant is not flowing, that is, it is deemed that the refrigerant temperature is that of the air temperature of the use unit; hence, it is determined to be appropriate. Whereas, if the refrigerant temperature is under 2° C. below room temperature, it is determined to be not appropriate since the refrigerant is flowing therethrough. Here, the refrigerant temperature is the detection temperature of the temperature sensors 206*a* to 206*d*.

Note that a temperature sensors that detect the refrigerant temperature in the use side heat exchangers 9*a* to 9*d* may be provided. In this case, the refrigerant temperature may be the temperate in the use side heat exchangers 9*a* to 9*d*. That is, any temperature between the inside of the use side heat exchangers 9*a* to 9*d* to the gas side of the use side heat exchangers 9*a* to 9*d* may be measured and this refrigerant temperature may be determined if it is appropriate or not.

When all of the refrigerant temperatures are appropriate in the second use units 307 having the branch port whose use side decompression mechanism 8 has been throttled, the process proceeds to step S27.

On the other hand, if there is a second use unit 307 that is not appropriate, the process proceeds to step S27 after alarming wire abnormality (non-correspondence between the transmission line and the refrigerant pipe) in step S26.

In step 27, the control unit 104 returns the opening degree of each of the use side decompression mechanisms 8 that has been operated in step S24 to the opening degree before the above step S24 had been performed.

Next, in step S28, the control unit 104 determines whether the use side decompression mechanisms 8*a* to 8*d* has performed throttling in the branch ports in the number of branch ports equivalent to or more than half the number of the connected second use units 307*a* to 307*d* subtracted by one (half the connected number of units−one unit).

The control unit 104 returns to step S23 again if more than half the connected number of units−one unit have not been throttled and determines the branch ports of the branch unit 302 again.

On the other hand, when more than half the connected number of units−one unit have been throttled, the control unit 104 determines whether a wiring abnormality alarm has been issued in step S29. If there has been no wiring abnormality alarm, the control unit 104 notifies normality (correspondence between the transmission lines and the refrigerant pipes) in step S30 and ends the correspondence determination operation in step S31.

With the above operation, it will be possible to perform non-correspondence determination between the transmission lines and the refrigerant pipes in a short time while averting an abnormal operation state to occur in a multi air-conditioning apparatus, such as the multi air-conditioning apparatus 200 of Embodiment 2, whose system configuration does not allow simultaneous operation of the cooling and the heating operation and that is provided with use side decompression mechanisms 8 each decompressing the refrigerant from the corresponding one of the second use units 307*a* to 307*d* in the second branch unit 306*a*.

Note that the detection of the non-correspondence between the refrigerant pipes and the transmission lines is equivalent to detection of the non-correspondence between the branch ports and the set branch ports.

Note that in the above description, a case in which the trial operation mode is a trial cooling only operation has been described; however, if the outdoor air temperature is low, it will not be possible to perform the second cooling only operation mode C. Accordingly, if the outdoor air temperature is low, for example if it is 7° C. or lower, then the correspondence determination is performed in the trial heating operation mode.

The operation when performing the correspondence determination operation shown in FIG. 18 in the trial heating operation mode is substantially similar to that during the trial cooling operation mode; however, the following differs.

First, the correspondence determination operation in step S22 becomes a trial heating operation mode, that is, becomes the second heating only operation mode D. Further, in step S25, the determination of whether the refrigerant temperature is appropriate is different to that during the trial cooling operation since the refrigerant flows in the second use units 307*a* to 307*d* from the gas side to the liquid side. For example, if the temperature of the liquid refrigerant is under +2° C. above room temperature, it is determined to be appropriate deeming that no refrigerant is flowing therethrough, whereas, if +2° C. above room temperature or higher, it is determined to be not appropriate deeming that refrigerant is flowing therethrough. Here, the liquid refrigerant temperature is the detection temperature of the temperature sensors 205*a* to 205*d*. That is, the temperatures on the liquid side of the use side heat exchangers 9*a* to 9*d* are measured.

By altering the operation as above, it will be possible to perform the correspondence determination operation shown in FIG. 18 even with the trial heating operation, and, further, it will be possible to detect non-correspondence between the refrigerant pipes and the transmission lines.

Next, description will be given on the determination method of the correspondence between the second branch unit 306*b* and the third use units 308*a* to 308*d*.

The correspondence determination between the refrigerant pipes and the transmission lines are performed on the basis of the change in the operating state of the third use units 308 when the opening degrees of the hot water side decompression mechanisms 30*a* to 30*d* are changed. Since the procedure of the correspondence determination operation is similar to that of the second branch unit 306*a* and the second use units 307*a* to 307*d*, description will be given using the flowchart in FIG. 18.

The flowchart of FIG. 18 will be a determination with a trial hot water operation when the second use units 307*a* to 307*d* are substituted by the third use units 308*a* to 308*d*, the second branch unit 306*a* is substituted by the second branch unit 306*b*, the use side decompression mechanisms 8*a* to 8*d* are substituted by the hot water side decompression mechanisms 30*a* to 30*d*, and the correspondence determination operation in step S22 is changed to the trial hot water operation, that is, to the hot water only operation mode E.

Here, the determination in step S25 differs to the above-mentioned case of the second use units 307*a* to 307*d*.

That is, the third use units 308*a* to 308*d* are respectively connected to the water plate heat exchangers 28*a* to 28*d*, and irrespective of the opening degree of each of the hot water side decompression mechanisms 30*a* to 30*b*, it is less likely that a difference between the water temperature and the refrigerant temperature will occur. Accordingly, in the determination of step S25 of the trial hot water operation, determination is performed on whether the water temperature of the third use units 308*a* to 308*d* of the set branch port whose hot water side decompression mechanisms 30*a* to 30*d* has been throttled is appropriate or not.

As regards the determination of whether the water temperature is appropriate or not, when the outlet water temperature after the throttling of the hot water side decompression mechanisms 30*a* to 30*d* is lower than that before the throttling, it is determined to be appropriate deeming that the refrigerant is not flowing therethrough after the throttling, and other cases are determined to be not appropriate.

Here, the detection temperatures of the temperature sensors 211*a* to 211*d* before performing step S24 are designated as the outlet water temperatures before the throttling of the hot water side decompression mechanisms 30*a* to 30*d* and the detection temperatures of the temperature sensors 211*a* to 211*d* after performing step S24 are designated as the outlet water temperatures after the throttling of the hot water side decompression mechanisms 30*a* to 30*d*. The detection temperatures are stored in the storage unit 106 of the unit controller 101. That is, each of the temperature sensors 211*a* to 211*d* acts as outlet water temperature detection means.

As such, by performing the correspondence determination operation shown in FIG. 18, it will be possible to detect the non-correspondence between the refrigerant pipes and the transmission lines of the second branch unit 306*b* and the third use units 308*a* to 308*d*. Furthermore, the correspondence between a use unit that uses only the condensation heat and a branch unit can be detected in a short time without occurrence of an abnormal operation.

REFERENCE SIGNS LIST

1 compressor; 2 three-way valve; 3 heat source side heat exchanger; 4 heat source side fan; 5 heat source side decompression mechanism; 6 liquid pipe; 7*a*-7*d* liquid pipe; 8*a*-8*d* use side decompression mechanism; 8*f* use side decompression mechanism; 8*g* use side decompression mechanism; 9*a*-9*d* use side heat exchanger; 10*a*-10*d* gas pipe; 11*a*-11*d* solenoid valve; 12*a*-12*d* solenoid valve; 13 low-pressure gas pipe; 14 accumulator; 15*a*-15*d* branch port; 16*a*-16*d* branch port; 17 high-pressure gas pipe; 18 wiring terminal block; 19 wiring terminal block; 20*a*-20*d* wiring terminal block; 21*a*-21*g* wiring terminal block; 23 four-way valve; 24 air side pipe; 25 air side pipe; 26 hot water side pipe; 27*a*-27*d* gas pipe; 28*a*-28*d* water plate heat exchanger; 29*a*-29*d* liquid pipe; 30*a*-30*d* hot water side decompression mechanism; 31*a*-31*d* branch port; 32*a*-32*d* branch port; 33 hot water side pipe; 34 wiring terminal block; 35*a* wiring terminal block; 35*b* wiring terminal block; 36*a*-36*d* wiring terminal block; 37*a*-37*d* wiring terminal block; 100 multi air-conditioning apparatus; 101 unit controller; 102 measuring unit; 103 computing unit; 104 control unit; 105 unit communication unit; 106 storage unit; 107 determination unit; 121 controller control device; 122 input unit; 123 external communication unit; 124 display unit; 200 multi air-conditioning apparatus; 201 pressure sensor; 202 temperature sensor; 203 temperature sensor; 204 temperature sensor 205*a*-205*d* temperature sensor; 206*a*-206*d* temperature sensor; 207*a*-207*d* temperature sensor; 208 pressure sensor; 209*a*-209*d* temperature sensor; 210*a*-210*d* temperature sensor; 211*a*-211*d* temperature sensor 301 heat source unit; 302 branch unit; 303*a*-303*g* use unit; 304 branch unit; 304*a*-304*d* branch unit; 305 second heat source unit; 306*a*, 306*b* second branch unit; 307*a*-307*d* second use unit; 308*a*-308*d* third use unit; 320 external controller.

What is claimed is:

1. A multi air-conditioning apparatus, comprising:

at least one heat source unit including a compressor and a heat source side heat exchanger;

a plurality of use units each including a use side heat exchanger, and use unit refrigerant temperature detection devices each configured to detect a use unit refrigerant temperature that is a temperature of a refrigerant in the use side heat exchanger;

a pipe branch unit connecting one of the at least one heat source unit to the plurality of use units by refrigerant pipes, the pipe branch unit including a plurality of branch ports that divide a passage leading from the at least one heat source unit, the plurality of branch ports being connected to the plurality of use units, and a plurality of flow control valves respectively connected to each of the plurality of branch ports, the plurality of flow control valves configured to control a direction of distribution or a flow rate of the refrigerant flowing in each of the plurality of use units;

a refrigerant saturation temperature detection device configured to detect a refrigerant saturation temperature of the at least one heat source unit or the plurality of use units; and a unit controller connected to the at least one heat source unit and the plurality of use units, the unit controller including a storage unit that stores capacity information of each of the plurality of use units and that stores information of a set branch port that indicates a correspondence of each branch port connected to the corresponding one of the plurality of use units, a control unit that performs a correspondence determination operation, the correspondence determination operation operating at least one of the plurality of flow control valves and differentiating the direction of distribution or the flow rate of the refrigerant flowing from at least one of the plurality of use units to remaining ones of the plurality of use units, and a determination unit that determines, based on the use unit refrigerant temperatures during performance of the correspondence determination operation, a location of a non-correspondence between each of the plurality of branch ports that is connected to the corresponding one of the plurality of use units and the set branch port, wherein the control unit identifies the at least one of the plurality of flow control valves, operated in the correspondence determination operation, based on the capacity information of each of the plurality of use units, the refrigerant saturation temperature, and a use unit air temperature that is the temperature of the air that exchanges heat with the use side heat exchanger.

2. The multi air-conditioning apparatus of claim 1, wherein during the correspondence determination operation, the control unit obtains an operation switching capacity of the plurality of use units based on the capacity of each of the plurality of use units, the refrigerant saturation temperature, and the use unit air temperature, and controls at least one of the flow control valves among the plurality of flow control valves to operate such that a value of a total capacity of at least one of the plurality of use units in which the direction of distribution or the flow rate of the refrigerant is to be differentiated from the remaining ones of the plurality of use units does not exceed the operation switching capacity.

3. The multi air-conditioning apparatus of claim 1, wherein during the correspondence determination operation, when the flow control valves in plural numbers are to be operated, the control unit controls the flow control valves to operate in every other one of the arranged plurality of branch ports.

4. The multi air-conditioning apparatus of claim 1, wherein the plurality of branch ports are numbered in order of arrangement, and the control unit, extracts a first operation pattern that operates at least one of the flow control valves among the plurality of branch ports so as not to exceed the operation switching capacity, extracts a second operation pattern that operates at least one of the flow control valves among the plurality of branch ports so as not to exceed the operation switching capacity, and, during the correspondence determination operation, controls at least one of the flow control valves to operate based on the operation pattern that performs a fewest number of operation of at least one of the flow control valves among the first operation pattern and the second operation pattern.

5. The multi air-conditioning apparatus of claim 1, wherein at least one of the plurality of use units is connected to two or more branch ports by refrigerant pipes, during the correspondence determination operation, the control unit controls at least one of the flow control valves of the two or more branch ports that are connected to a same single use unit of the at least one of the plurality of use units to simultaneously operate, and the determination unit deems the two or more branch ports that are connected to the same single use unit of the at least one of the plurality of use units as a single branch port and determines the location of the non-correspondence between the single branch port and the set branch port.

6. The multi air-conditioning apparatus of claim 1, wherein at least one of the branch ports among the plurality of branch ports is connected to two or more use units by refrigerant pipes, and the determination unit deems the two or more use units that are connected to a same single branch port of the at least one of the branch ports as a single use unit and determines the location of the non-correspondence between the single branch port and the set branch port.

7. The multi air-conditioning apparatus of claim 1, further comprising an external controller that includes an input unit configured to input a start command of the correspondence determination operation;

an external communication unit configured to communicate with the unit controller; and a display unit configured to display the determination result of the determination unit of the unit controller.

8. The multi air-conditioning apparatus of claim 1, wherein the use unit refrigerant temperature detection devices detect the temperature of the refrigerant that is to flow into the use side heat exchanger, the temperature of the refrigerant that has flowed out from the use side heat exchanger, or a temperature of the refrigerant in the use side heat exchanger as the use unit refrigerant temperature, and the determination unit determines, based on the temperature difference between the use unit refrigerant temperature during performance of the correspondence determination operation and the use unit air temperature, the location of the non-correspondence between each of the branch ports that is connected to the corresponding one of the plurality of use units by refrigerant pipes and the set branch port obtained in accordance with the wiring connection.

9. The multi air-conditioning apparatus of claim 1, wherein at least one of the use side heat exchangers is constituted by at least one water plate heat exchanger that exchanges heat between water and the refrigerant, at least one of the plurality of use units that includes the water plate heat exchanger has a use side outlet water temperature detection device that detects an outlet water temperature that is a temperature of water that has flowed out from the water plate heat exchanger, during the correspondence determination operation, the control unit controls the storage unit to store the outlet water temperature before the at least one of the flow control valves is operated and the outlet water temperature after the at least one of the flow control valves is operated when the at least one of the flow control valves of the branch ports that is connected to the at least one of the plurality of use units that includes the water plate heat exchanger is operated, and the determination unit determines, based on the temperature difference between the outlet water temperature before the at least one of the flow control valves is operated and the outlet water temperature after the at least one of the flow control valves is operated, the location of the non-correspondence between each of the branch ports that is connected to the corresponding one of the plurality of use units by refrigerant pipes and the set branch port obtained in accordance with the wiring connection.

10. The multi air-conditioning apparatus of claim 1, wherein each of the plurality of use units includes a use side decompression mechanism that is capable of varying an opening degree and that decompresses the refrigerant that is to flow into the corresponding one of the use side heat exchanger or the refrigerant that has flowed out of the corresponding one of the use side heat exchanger, and during the correspondence determination operation, the control unit performs control increasing the opening degree of the use side decompression mechanism of the use unit that is connected to the branch ports which are the set branch ports whose flow control valves have not been operated, according to a value of a total capacity of the plurality of use units and a value of a total capacity of the at least one of the plurality of use units that is connected to the branch ports which are the set branch ports whose flow control valves have been operated.

11. The multi air-conditioning apparatus of claim 10, wherein the storage unit stores a capacity of the at least one heat source unit, and during the correspondence determination operation, the control unit performs control reducing the opening degree of the use side decompression mechanism of the use unit that is connected to the branch ports which are the set branch ports whose flow control valves have been operated, according to a value of a total capacity of the plurality of use units, a value of a total capacity of the at least one of the plurality of use units that is connected to the branch ports which are the set branch ports whose flow control valves have been operated, and the capacity of the at least one heat source unit.

12. The multi air-conditioning apparatus of claim 11, wherein during the correspondence determination operation, the control unit reduces a heat exchange capacity of the heat source side heat exchanger according to the value of the total capacity of the at least one of the plurality of use units that is connected to the branch ports which are the set branch ports whose flow control valves have been operated, and the capacity of the at least one heat source unit.

13. The multi air-conditioning apparatus of claim 1, wherein each of the flow control valves is capable of varying an opening degree and controls the flow rate of the refrigerant flowing in the plurality of use units, and during the correspondence determination operation, the control unit closes at least one of the flow control valves among the plurality of flow control valves, and performs control increasing the opening degree of remaining ones of the plurality of control valves, according to a value of a total capacity of the plurality of use units and a value of a total capacity of the at least one of the plurality of use units that is connected to the closed flow control valves.

14. The multi air-conditioning apparatus of claim 1, further comprising a use unit air temperature detection device configured to detect the use unit air temperature, wherein the unit controller is connected to the at least one heat source unit and the plurality of use units by wired connection, and the set branch port is obtained in accordance with the wire connection.

15. The multi air-conditioning apparatus of claim 1, wherein the control unit, during the correspondence determination operation, compares the capacity of each use unit, the refrigerant saturation temperature, and the use unit air temperature that is the temperature of the air that exchanges heat with the use side heat exchanger in order to identify the location of the non-correspondence of the at least one of the plurality of flow control valves.

16. The multi air-conditioning apparatus of claim 1, wherein the correspondence determination operation determines whether a wiring abnormality has occurred between each of the plurality of branch ports.

17. The multi air-conditioning apparatus of claim 1, wherein the control unit is configured to provide an incorrect wiring alert, which indicates that a wiring abnormality has occurred, after the determination unit detects the non-correspondence between each of the plurality of branch ports.

* * * * *